US007575296B2

(12) United States Patent
Yoshida

(10) Patent No.: US 7,575,296 B2
(45) Date of Patent: Aug. 18, 2009

(54) LIQUID EJECTION APPARATUS WITH LIQUID WIPER DEVICE

(75) Inventor: Atsushi Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 325 days.

(21) Appl. No.: 11/179,824

(22) Filed: Jul. 13, 2005

(65) Prior Publication Data

US 2006/0012629 A1 Jan. 19, 2006

(30) Foreign Application Priority Data

Jul. 14, 2004 (JP) ..... 2004-207184
Jul. 14, 2004 (JP) ..... 2004-207185
Jun. 23, 2005 (JP) ..... 2005-184148
Jun. 23, 2005 (JP) ..... 2005-184149

(51) Int. Cl.
*B41J 2/165* (2006.01)
*B41J 25/308* (2006.01)

(52) U.S. Cl. ..... 347/33; 347/8; 347/22

(58) Field of Classification Search ..... 347/33, 347/8

See application file for complete search history.

(56) References Cited

U.S. PATENT DOCUMENTS 5,432,539 A * 7/1995 Anderson ..... 347/33
5,689,293 A * 11/1997 Hirano ..... 347/33
5,793,390 A * 8/1998 Claflin et al. ..... 347/33
6,109,725 A * 8/2000 Saikawa et al. ..... 347/33
2003/0227507 A1 12/2003 Kinoshita et al.
2004/0130588 A1 * 7/2004 Nakagawa et al. ..... 347/33
2005/0035991 A1 * 2/2005 Fredrickson ..... 347/33
2005/0104925 A1 * 5/2005 Kimura ..... 347/33

FOREIGN PATENT DOCUMENTS

EP 0 410 691 A1 1/1991
EP 1 010 535 A2 6/2000
EP 1 016 529 A1 7/2000
JP 6-23999 A 2/1994
JP 10-278249 A 10/1998
JP 11-334090 A 12/1999
JP 2000-318171 11/2000
JP 2001-18405 A 1/2001
JP 2001-30507 A 2/2001

* cited by examiner

*Primary Examiner*—Stephen D Meier
*Assistant Examiner*—Kar Yip
(74) *Attorney, Agent, or Firm*—Sughrue Mion, PLLC

(57) ABSTRACT

An inkjet printer includes a recording head ejecting ink from a nozzle plate surface, a plurality of wipers moving in a predetermined movement direction with respect to the recording head for wiping the liquid from the nozzle plate surface, and a movement device for moving the wipers in the movement direction. The movement device moves the wipers at variable intervals in the movement direction, so that the wipers can wipe the nozzle plate surface independently from one another.

22 Claims, 21 Drawing Sheets

| Distance from Base Point [mm] | Feed Pitch [mm] |
|---|---|
| 0 | 0.8 |
| 28 | 0.8 |
| 31 | 7.2 |
| 67 | 7.2 |
| 70 | 0.8 |
| 103 | 0.8 |

LIQUID EJECTION APPARATUS WITH LIQUID WIPER DEVICE

BACKGROUND OF THE INVENTION

The present invention relates to liquid ejection apparatuses ejecting liquid from a nozzle opening surface of a liquid ejection head, and, more particularly, to liquid ejection apparatuses having liquid wiper devices wiping the liquid from the nozzle opening surface.

As a liquid ejection apparatus ejecting liquid to a target, an inkjet type recording apparatus ejecting ink drops from a recording head to a recording medium for performing printing is known. More specifically, the apparatus ejects ink drops from nozzles of the recording head to the recording medium for defining an image including characters and graphics on the recording medium as desired.

When printing, the recording head of the apparatus is held relatively close to the recording medium. Thus, if the ink drops splash when hitting the recording medium, the ink splash may be received by the nozzle opening surface of the recording head, and the nozzle opening surface may be contaminated.

Particularly, if the apparatus is an on-demand type, the ink drops are ejected through slight pressurization of the ink in the vicinity of each of the nozzles. The ejection energy is thus relatively small, and the recording head must be held at a position as close as several millimeters from the recording medium. Accordingly, the nozzle opening surface easily catches the ink splashes. Further, since only relatively small pressure is applied to the ink, the pressure is insufficient for removing the ink from the clogged nozzles.

Thus, for removing the ink from the clogged nozzles, the apparatus performs ink suction, or draws the ink from the nozzle openings, when the apparatus is not in printing operation.

However, even after the ink suction is performed, the ink may remain in the nozzle opening surface. The remaining ink may cause the nozzle opening surface to be contaminated by fibers from the recording medium, which is a sheet of paper, or by dirt. This may lead to clogging of the nozzles, a failure of ink ejection, or offset ink ejection, as the recording head is repeatedly used.

For solving the problem, a wiper device for wiping the ink from the nozzle opening surface has been proposed, as described in Japanese Laid-Open Patent Publications Nos. 2001-30507 and 11-334090.

Japanese Laid-Open Patent Publications No. 2001-30507 describes a wiper device including a plurality of wiper blades each corresponding to one of nozzle heads ejecting different color inks. Each of the nozzle heads includes multiple nozzles aligned in a main scanning direction. Each of the wiper blades is movable in the main scanning direction. The wiper blades are carried separately by corresponding carriers. Each of the carriers is moved in the main scanning direction through rotation of an associated lead screw. The lead screws are driven independently from each other by corresponding drive sources. This structure makes it necessary to provide the drive sources in the quantity corresponding to the quantity of the wiper blades. Thus, as the quantity of the wiper blades is increased, the mechanism for moving the wiper blades becomes complicated and enlarged.

Further, Japanese Laid-Open Patent Publications No. 2001-30507 describes another wiper device including a plurality of wiper blades carried by a single carrier. The structure decreases the quantity of the lead screws and that of the drive sources, as compared to the quantity of the wiper blades.

However, since the carrier moves the wiper blades altogether, the wiper blades wipe the corresponding nozzle heads, regardless of whether the nozzle heads require wiping or not. Therefore, if the nozzle openings of the nozzle head are wiped by the corresponding wiper blade without being subjected to the aforementioned ink suction, so-called missing dots may be caused by the nozzle openings. In this case, the ink cannot be reliably ejected to the recording medium, thus leading to a printing failure.

In contrast, Japanese Laid-Open Patent Publication No. 11-334090 describes a wiper device including a plurality of wiper blades formed of the same material secured to the outer circumference of a rotatable blade support. More specifically, the blade support has a polygonal shape and the wiper blades are secured to each of the sides of the blade support. When a carriage carrying a recording head moves from its home position to a recording area, the recording head slides on one of the wiper blades and is wiped by the wiper blade. Further, by rotating the blade support, the wiper blades may be selected as desired.

However, since the multiple wiper blades are secured to the outer circumference of the blade support, the blade support must be relatively large. Further, since the blade support is rotated in the inkjet type recording apparatus, a relatively large space in the recording apparatus must be ensured specifically for the blade support. This further enlarges the recording apparatus. Also, although the wiper blades can be selected as desired by rotating the blade support, the wiper blades are formed of the same material. This makes it impossible to perform wiping suitably for a current contamination state of the recording head.

SUMMARY OF THE INVENTION

Accordingly, it is an objective of the present invention to provide a simply configured and minimized liquid ejection apparatus that selectively wipes a plurality of nozzle opening lines defined in a liquid ejection head.

It is another objective of the invention to provide a compact liquid ejection apparatus capable of wiping the liquid ejection head in correspondence with a current contamination state of the liquid ejection head.

To achieve the foregoing and other objectives and in accordance with the purpose of the present invention, the invention provides a liquid ejection apparatus ejecting a liquid from a nozzle opening surface of a liquid ejection head. The apparatus includes a plurality of wipers moving in a predetermined movement direction with respect to the liquid ejection head for wiping the liquid from the nozzle opening surface. Each of the wipers is movable in the movement direction in an operational area for wiping the nozzle opening surface, a first non-operational area that precedes the operational area, and a second non-operational area that follows the operational area. A movement device moves the wipers in the movement direction in such a manner that an interval between each adjacent pair of the wipers in the movement direction when at least one of the wipers is moving in the operational area is different from the interval when both wipers are moving in the first or second non-operational area.

The present invention also provides a liquid ejection apparatus ejecting liquid from a nozzle opening surface of a liquid ejection head. The apparatus includes a plurality of wipers moving in a predetermined movement direction with respect to the liquid ejection head for wiping the liquid from the nozzle opening surface. The wipers are arranged in the movement direction. A movement device moves the wipers in the movement direction for allowing the wipers to wipe the nozzle opening surface independently from one another.

The present invention further provides a liquid ejection apparatus ejecting liquid from a nozzle opening surface of a liquid ejection head. The apparatus includes a plurality of wipers moving in a predetermined movement direction with respect to the liquid ejection head for wiping the liquid from the nozzle opening surface, and a movement device for moving the wipers in the movement direction. The movement device includes at least one lead screw extending in the movement direction and engaging the wipers.

In addition, the present invention provides a liquid ejection apparatus ejecting liquid from a nozzle opening surface of a liquid ejection head. The apparatus includes different types of wipers moving in a predetermined movement direction with respect to the liquid ejection head for wiping the liquid from the nozzle opening surface, and a movement device for moving the wipers in the movement direction independently from one another in such a manner that the different types of wipers wipe the same area of the nozzle opening surface.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be described with reference to the attached drawings.

Figure 1:
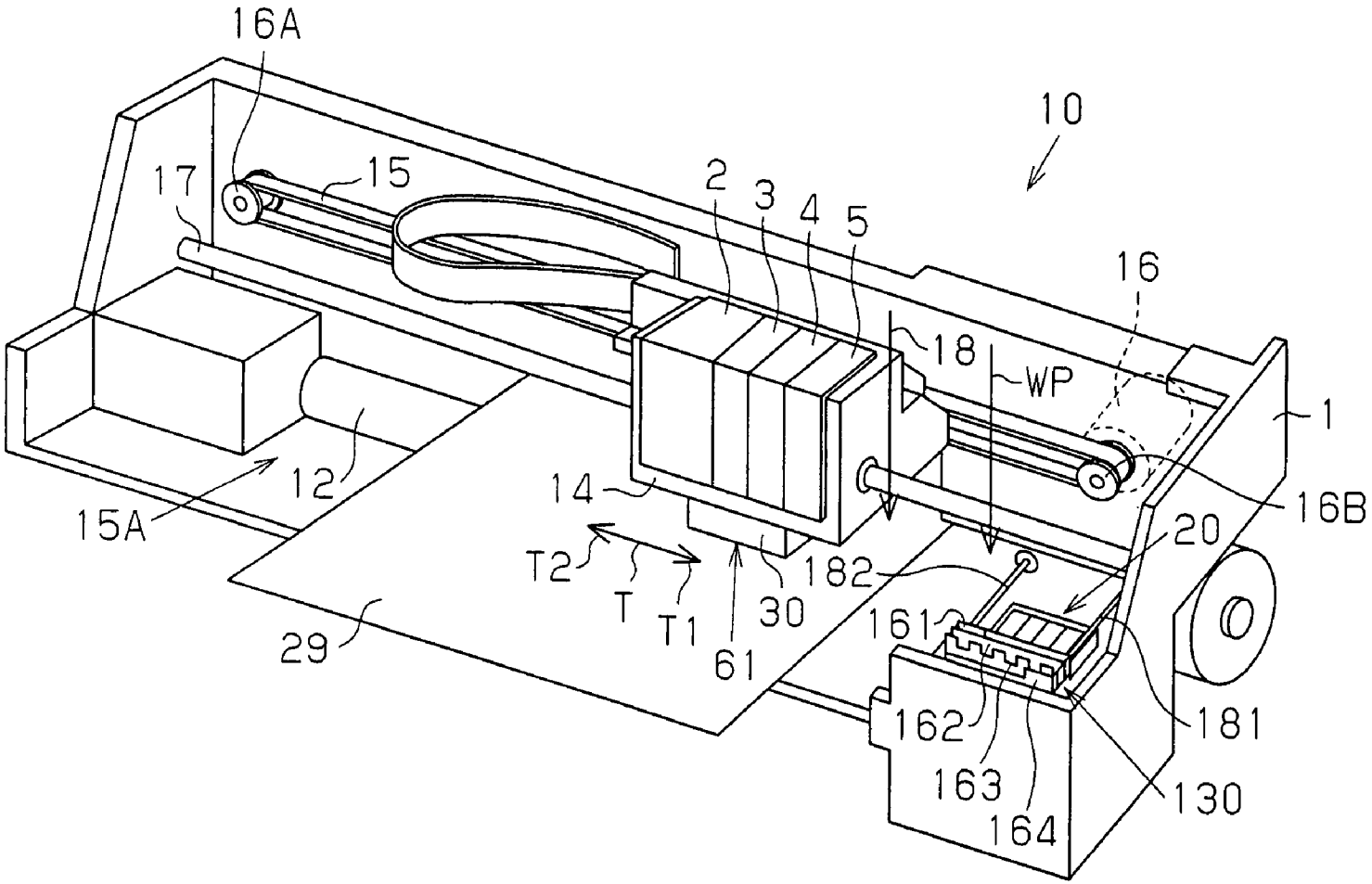
FIG. 1 is a perspective view showing an inkjet type recording apparatus according to an embodiment of the present invention.

FIG. 1 shows an inkjet type recording apparatus (hereinafter, referred to as an "inkjet printer") 10, or a liquid ejection apparatus. The inkjet printer 10 has a body 1 including a guide rail 17, a platen 12, a carriage 14, an ink suction device 20 as a liquid suction device, a recording (printing) head 30 serving as a liquid ejection head, and an ink wiper device 130 serving as a liquid wiper device. The ink suction device 20 forms part of a liquid discharge system.

The inkjet printer 10 is a so-called on-carriage type recording apparatus and a plurality of ink cartridges 2, 3, 4, 5 are removably installed in the carriage 14. Although the ink cartridges 2 to 5 are directly carried by the carriage 14 in the embodiment of FIG. 1, the present invention may be applied to a so-called off-carriage type inkjet recording apparatus in which the ink cartridges 2 to 5 are installed in a portion other than the carriage.

The recording head 30 is provided below the carriage 14. The carriage 14 is connected to a belt 15 revolved by a motor 16. The belt 15 is wound around a pair of pulleys 16A, 16B. The pulley 16B is fixed to a rotary shaft of the motor 16. When the motor 16 runs, the carriage 14 reciprocates along the guide rail 17 in a main scanning direction T (directions T1 or T2), the axial direction of the platen 12, together with the recording head 30. The position of the carriage 14 is determined in correspondence with the drive amount of the motor 16.

As viewed in FIG. 1, a wiping position WP and a standby position 18 are defined in a right part of the body 1. The wiping position WP is also called a "home position". The carriage 14 is held at the wiping position WP when a nozzle plate surface 61 of the recording head 30 is subjected to suction by the ink suction device 20 or wiping by the ink wiper device 130. In contrast, the carriage 14 is held at the standby position 18 when the recording head 30 is subjected to neither the suction nor the wiping.

The ink suction device 20 may be referred to as a "capping system" or a "capping means". The ink suction device 20 has humidifying function, or prevents the nozzle openings of the recording head 30 from drying. The ink suction device 20 also has suction function, or supplies negative pressure from a suction pump 19 to the nozzle openings for forcibly drawing and discharging the ink from the nozzle openings.

Each of the ink cartridges 2 to 5 retains ink, which is liquid. The ink cartridges 2 to 5 may retain the same type of ink or different types of ink. The different types of ink may be inks of apparently different colors or inks of different contents or compositions. If the inkjet printer 10 is a color printer, the ink cartridges 2 to 5 retain different color inks. The position of the ink wiper device 130 substantially corresponds to that of the ink suction device 20.

Figure 2:
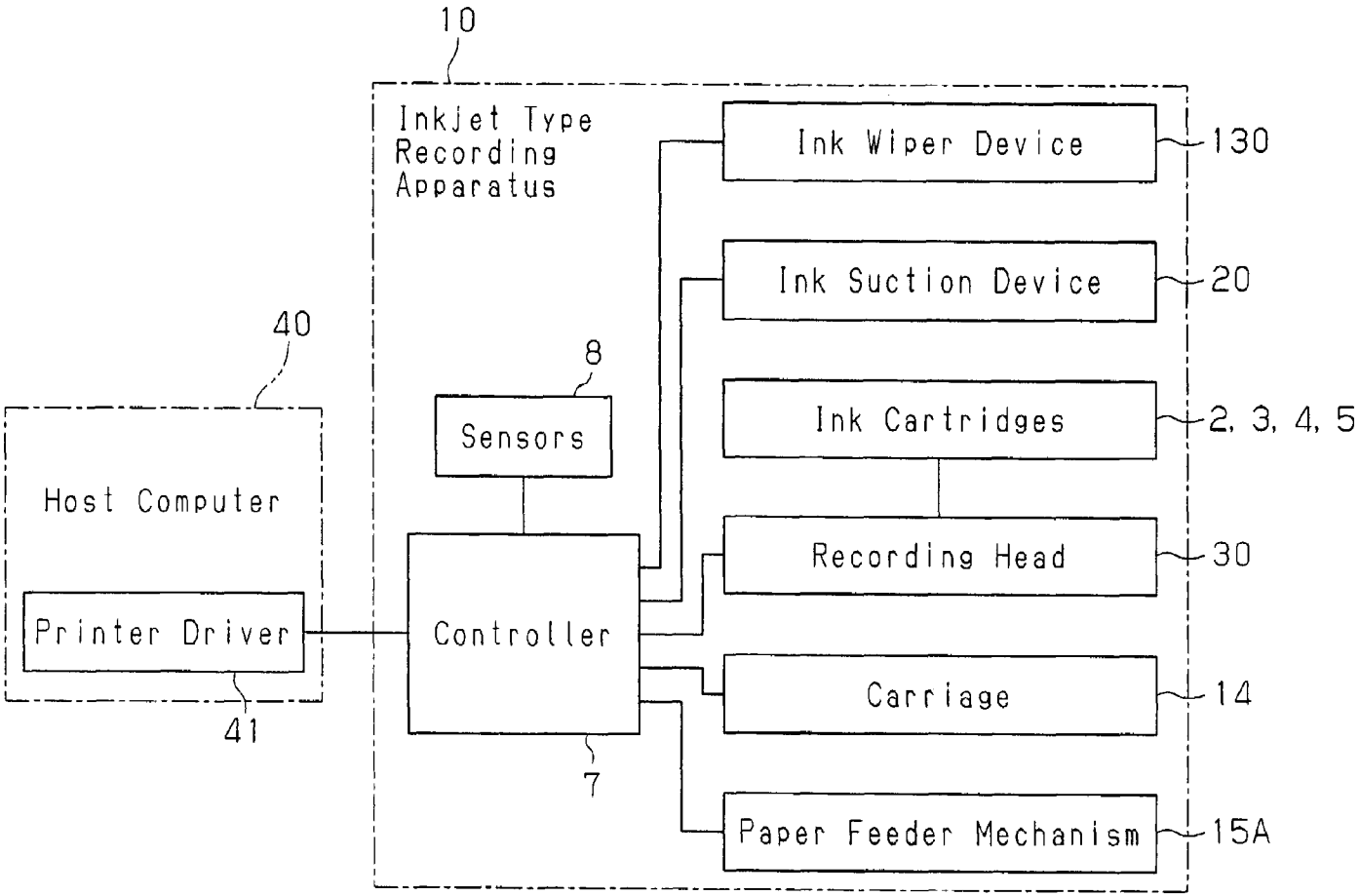
FIG. 2 is a block diagram representing the electrical configuration of the apparatus of FIG. 1.

As shown in FIG. 2, a controller 7 of the inkjet printer 10 is connected to a printer driver 41 of a host computer 40 through a local printer cable or a communication network. The printer driver 41 includes software for sending commands to components of the inkjet printer 10 for performing printing or wiping or ink suction with respect to the nozzle plate surface 61.

The controller 7 receives detection signals from sensors 8 each detecting the operational state of the inkjet printer 10. The controller 7 also controls the ink wiper device 130, the ink suction device 20, the recording head 30, the carriage 14, and a paper feeder mechanism 15A. The paper feeder mechanism 15A includes the platen 12 and sends a paper sheet 29, or the recording medium (the target), in a sub scanning direction perpendicular to the main scanning direction T, as shown in FIG. 1. The paper sheet 29 moves over the platen 12.

Figure 3:
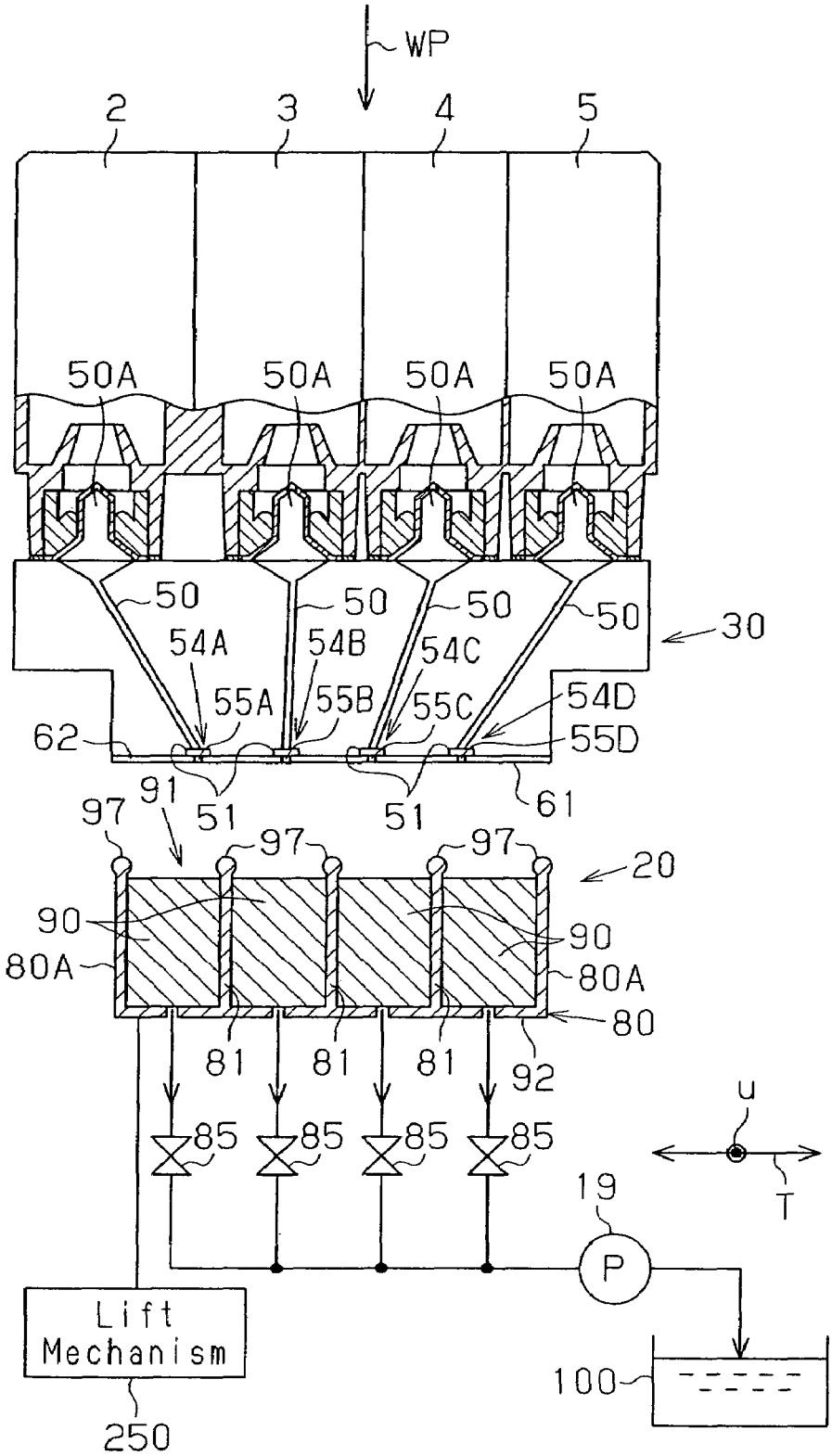
FIG. 3 is a view showing an ink suction device and a recording head, each held in a standby state.
Figure 4:
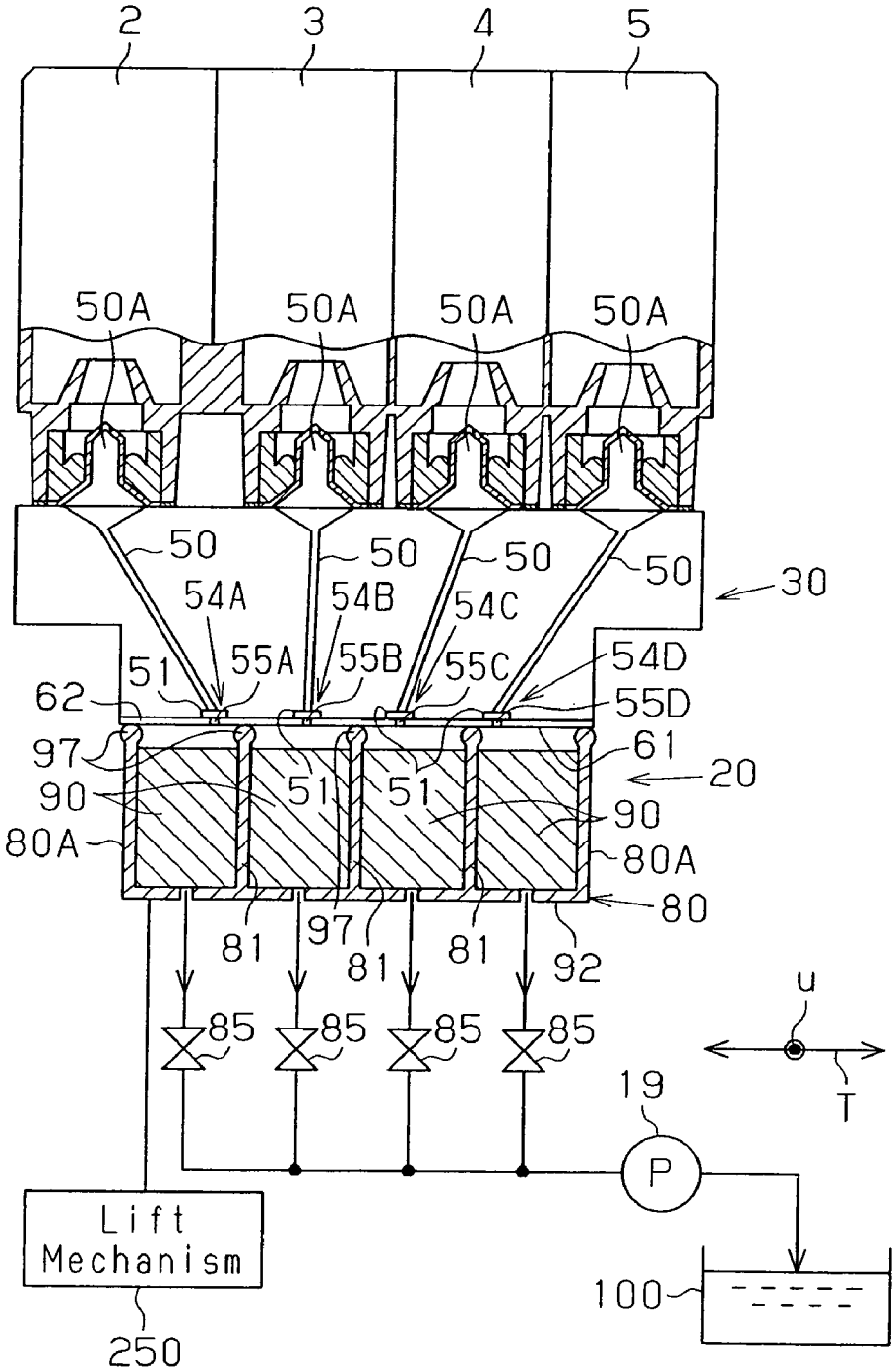
FIG. 4 is a view showing a suction state of the ink suction device with respect to a nozzle plate surface.

As shown in FIGS. 3 and 4, the recording head 30 includes a plurality of ink passages 50. The ink passages 50 are arranged independently from one another and each corresponds to one of the ink cartridges 2 to 5. An ink supply needle 50A is formed at one end of each ink passage 50 and is connected to the corresponding one of the ink cartridges 2 to 5. The ink flows from each ink cartridge 2 to 5 to the corresponding ink passage 50 through the associated ink supply needle 50A. Each ink passage 50 is connected to a corresponding one of pressure chambers 51.

A nozzle plate 62 having the nozzle plate surface 61 is formed in a lower surface of the recording head 30. The nozzle plate surface 61, or the nozzle opening surface, includes a plurality of nozzle opening lines 54A, 54B, 54C, and 54D. Each of the nozzle opening lines 54A to 54D includes a plurality of nozzle openings 55A to 55D, which are aligned linearly (see FIGS. 5(A) and 5(B)). Each of the nozzle openings 55A to 55D is connected to the corresponding one of the pressure chambers 51. Thus, after the ink drops are pressed out of the pressure chambers 51, the ink drops are ejected from the corresponding nozzle opening 55A to 55D.

The ink suction device 20 is brought into tight contact with or pressed against the nozzle plate surface 61 for subjecting the nozzle openings 55A to 55D to suction. The ink suction device 20 includes a cap body 80 and a plurality of absorption materials 90. The cap body 80 has a box-like shape and includes an upper opening 91. A plurality of partitions 81 project from a bottom 92 of the cap body 80. A plurality of chambers are thus defined by the partitions 81 and four side walls 80A of the cap body 80. Each of the chambers receives one of the absorption materials 90. Each of the absorption materials 90 corresponds to an area of the nozzle plate surface 61 including one of the nozzle opening lines 54A to 54D.

Each of the absorption material 90 is formed of material that absorbs ink, which is, for example, a sponge of polyvinyl alcohol (PVA). It is preferred that the absorption materials 90 are highly hydrophilic, have a continuous porous structure, and are highly ink-absorbent. The absorption materials 90 are held by a non-illustrated holding member in such a manner that the absorption materials 90 are supported by the cap body 80.

The four chambers of the cap body 80, which are defined by the partitions 81, are connected to a suction pump 19 through the bottom 92. The suction pump 19 is connected to a waste ink reservoir 100. The waste ink reservoir 100 retains the waste ink drawn from the cap body 80 by the suction pump 19. A plurality of open-close valves 85 are arranged between the cap body 80 and the suction pump 19 and each corresponds to one of the four chambers receiving the absorption materials 90. If the suction pump 19 is driven with the open-close valves 85 held open, the negative pressure generated by the suction pump 19 is applied to the cap body 80. In contrast, if the open-close valves 85 are closed, the cap body 80 does not receive the negative pressure regardless of the actuation of the suction pump 19. By operating the four open-close valves 85 selectively, the four chambers of the cap body 80 may be placed under negative pressure selectively, for permitting ink suction. Since the lines extending from the open-close valves 85 to the suction pump 19 are joined together as a single line, the selective ink suction with respect to the four chambers is enabled by the single suction pump 19.

In FIG. 3, the ink suction device 20 is held in a standby state separated from the nozzle plate surface 61. In FIG. 4, the ink suction device 20 is held in a state in tight contact with the nozzle plate surface 61 and sealing the nozzle plate surface 61 (a suction state or a humidifying state). A lift device 250 selectively raises or lowers the cap body 80 between the position of FIG. 3 and the position of FIG. 4.

If the ink in the recording head 30 contains bubbles or the viscosity of the ink in the ink passages 50 or the pressure chambers 51 is increased, a smooth ink flow may be hampered and ink ejection may not be performed normally. In these cases, the ink suction device 20 must forcibly remove the ink from the recording head 30.

Further, at the initial use of the inkjet printer 10 or when the ink cartridges 2 to 5 are replaced by different types of ink cartridges from the original types, it is necessary to introduce the ink into the ink passages 50 of the recording head 30. Such initial introduction of the ink is performed by the ink suction device 20. Use of the ink suction device 20 forcibly draws the air and the ink from the recording head 30 through the nozzle openings 55A to 55D, thus discharging the ink from the nozzle openings 55A to 55D.

Figure 5A:
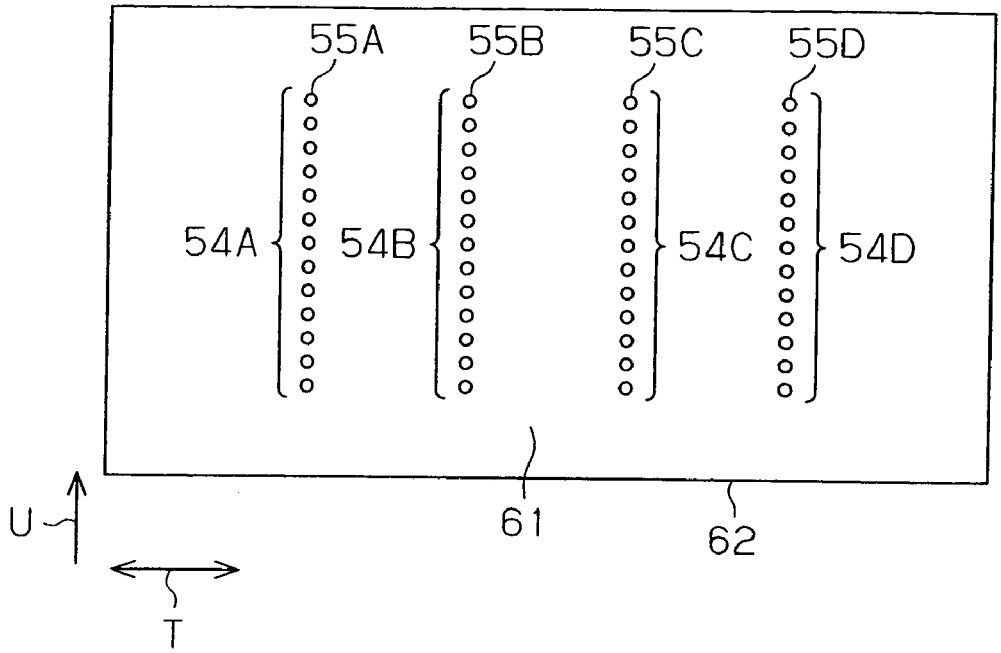
FIG. 5(A) is a front view showing a nozzle plate.
Figure 5B:
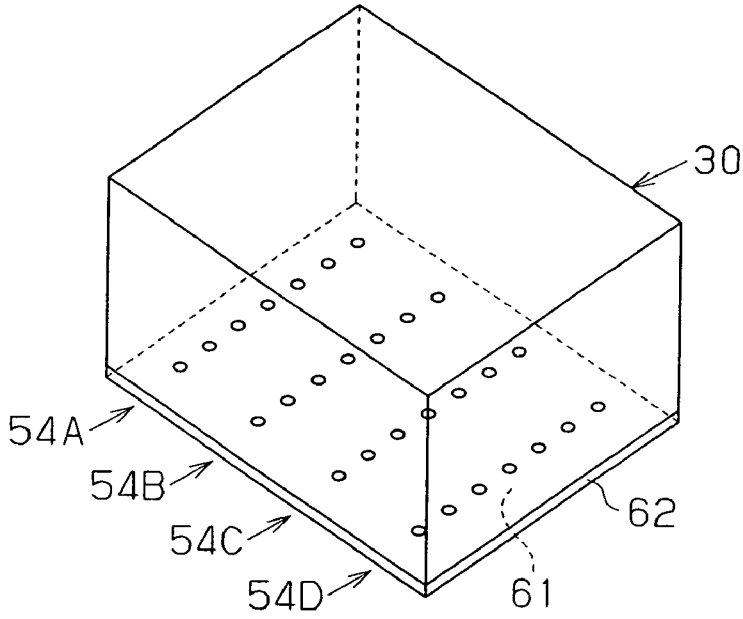
FIG. 5(B) is a perspective view showing the nozzle plate.

FIGS. 5(A) and 5(B) show the alignment of each of the first to fourth nozzle opening lines 54A to 54D with respect to the nozzle plate surface 61. Each nozzle opening line 54A to 54D includes, for example, ten to a thousand of nozzle openings 55A to 55D. Each nozzle opening line 54A to 54D extend in the sub scanning direction U perpendicular to the main scanning direction T of FIG. 5(A). The nozzle opening lines 54A to 54D are arranged parallel with each other with respect to the main scanning direction T, as spaced at equal intervals.

Figure 6:
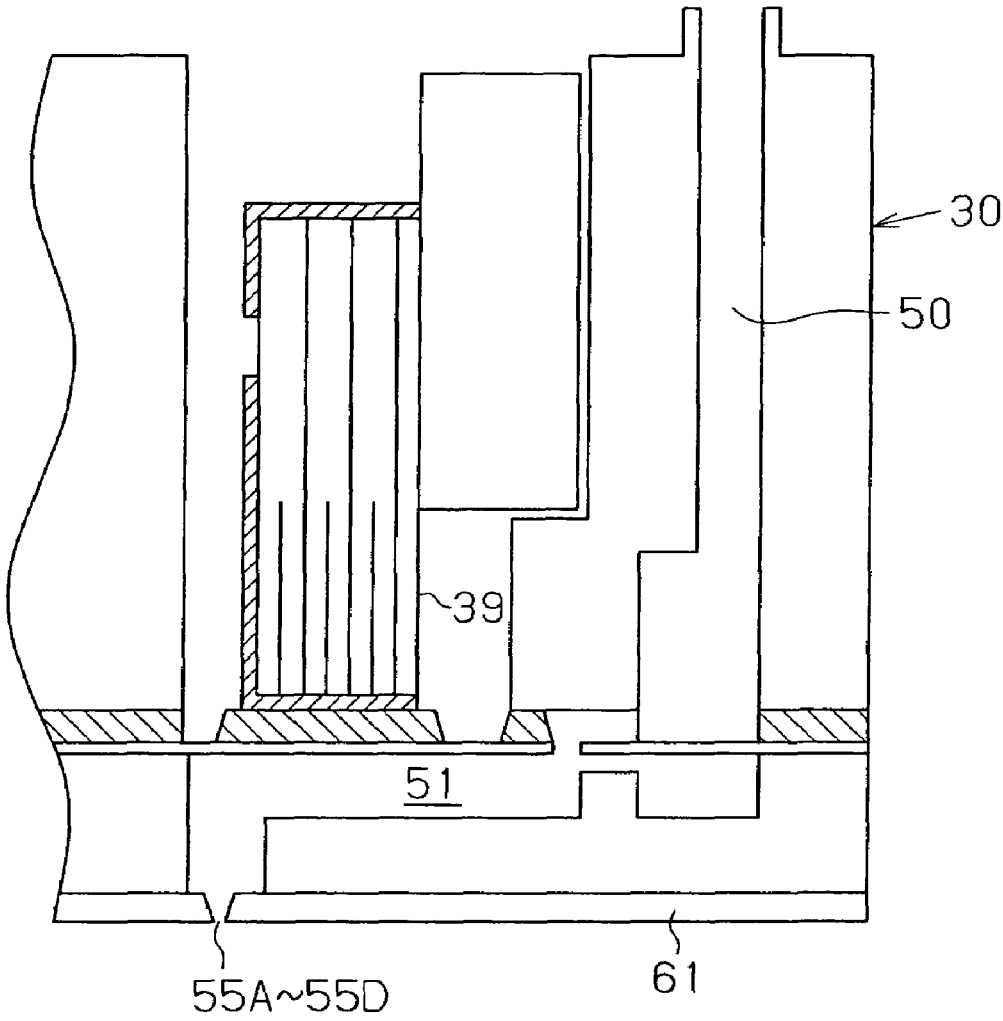
FIG. 6 is a view showing the structure of the vicinity of a piezoelectric oscillator in the recording head.

FIG. 6 shows the structure of the interior of the recording head 30. The ink in each ink cartridge 2 to 5 is supplied to the corresponding pressure chamber 51 through the associated ink passage 50. The recording head 30 includes a plurality of piezoelectric oscillators 39 serving as pressure generating elements. Each of the piezoelectric oscillators 39 corresponds to one series of the nozzle openings 55A to 55D, or, in other words, one of the pressure chambers 51. In printing, each piezoelectric oscillator 39 is selectively extended or retracted so as to vary the volume of the corresponding pressure chamber 51. This changes the pressure of the ink in the pressure chamber 51. In this manner, the ink drops are ejected from the corresponding nozzle openings 55A to 55D.

Figure 7:
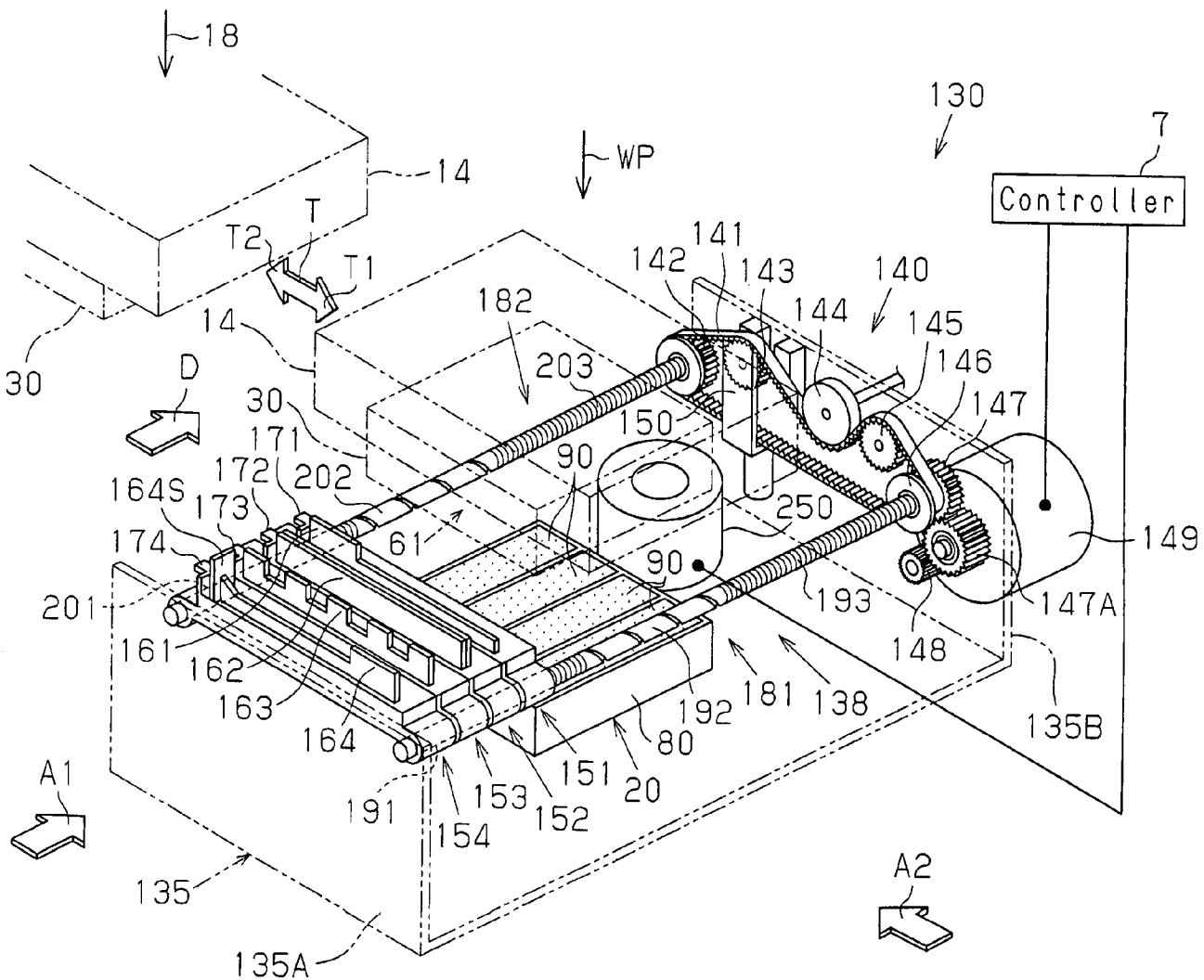
FIG. 7 is a perspective view showing an ink wiper device.
Figure 8:
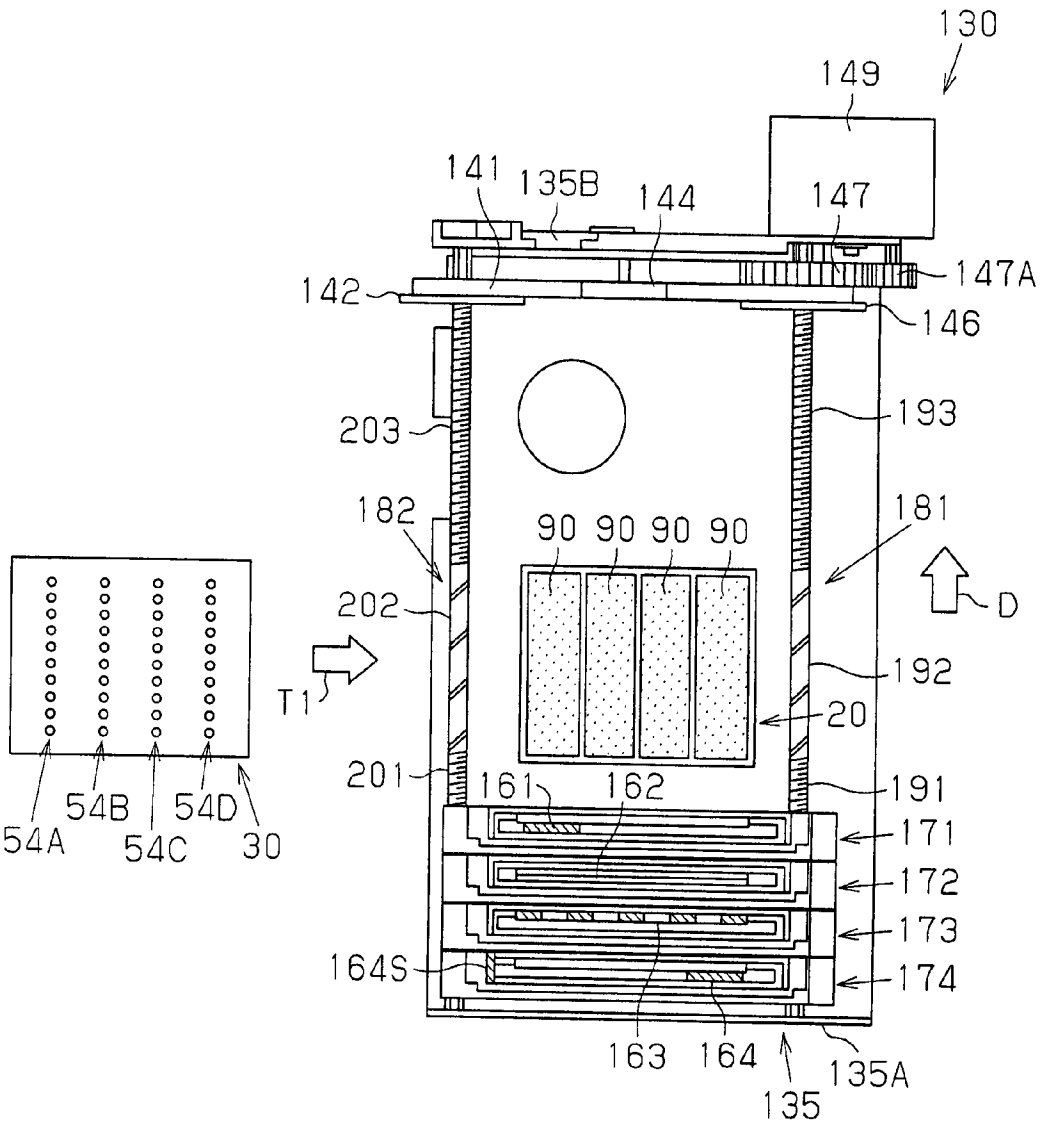
FIG. 8 is a plan view showing the ink wiper device.

FIGS. 7 and 8 show the structure of the ink wiper device 130. The ink wiper device 130 includes a frame 135, a plurality of wipers 151 to 154, and a movement device 138. The wipers 151 to 154 are aligned in a direction D perpendicular to the main scanning direction T and are moved by the movement device 138 in the direction D.

The first wiper 151 includes a first blade 161 and a first holder member 171. The second wiper 152 includes a second blade 162 and a second holder member 172. The third wiper 153 includes a third blade 163 and a third holder member 173. The fourth wiper 154 includes a fourth blade 164 and a fourth holder member 174.

Figure 9:
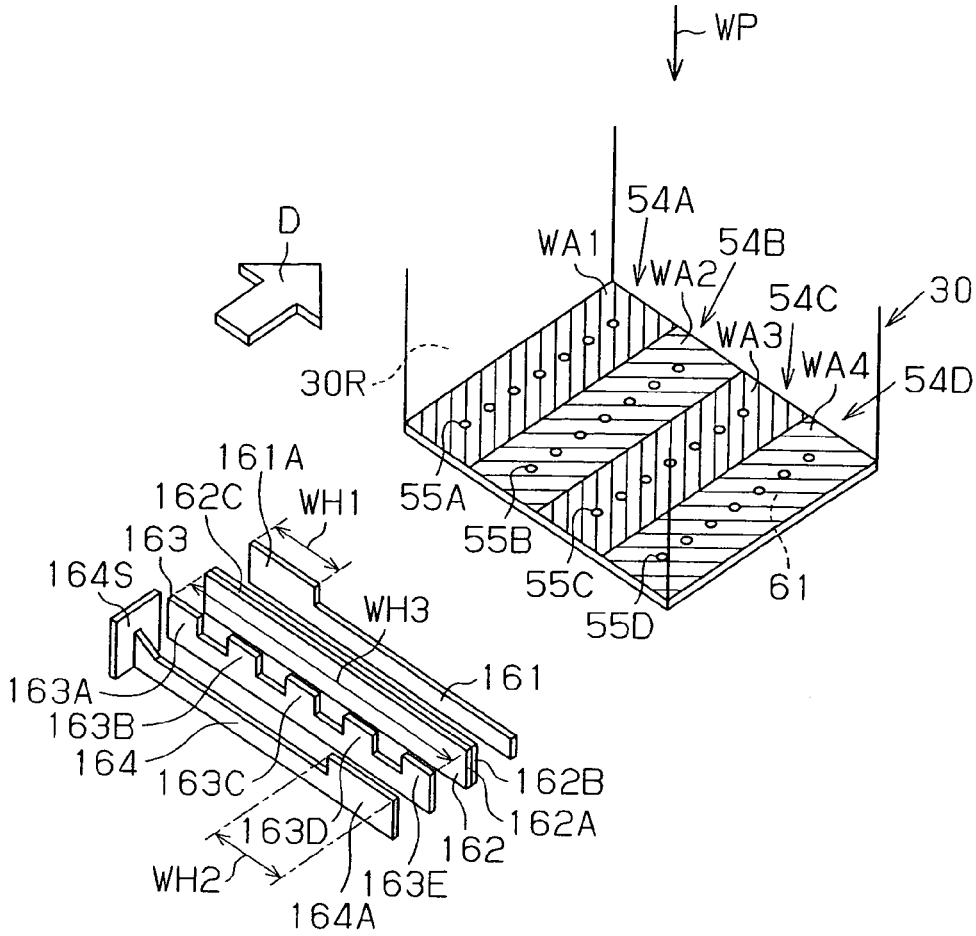
FIG. 9 is a perspective view showing wiping areas of the nozzle plate surface with respect to blades.

The first to fourth holder members 171 to 174 are shaped identically. The first to fourth blades 161 to 164 are formed by different types of blades. Accordingly, the first to fourth wipers 151 to 154 are different types of wipers. The different types of blades may be blades of different materials or different shapes or blades of different materials and different shapes. As shown in FIG. 9, the first to fourth blades 161 to 164 of the first embodiment have different shapes. It is preferred that the first to fourth blades 161 to 164 are formed of elastically deformable material such as rubber, elastomer, and plastic. Alternatively, the blades 161 to 164 may be formed of ink-absorbent material.

Referring to FIG. 9, the nozzle plate surface 61 may be divided into, for example, four wiping areas WA1 to WA4 sized equally. The first wiping area WA1 includes the first nozzle opening line 54A. The second wiping area WA2 includes the second nozzle opening line 54B. The third wiping area WA3 includes the third nozzle opening line 54C. The fourth wiping area WA4 includes the fourth nozzle opening line 54D.

The first blade 161 has a wiping portion 161A of a wiping dimension WH1 corresponding to the first wiping area WA1 (see FIG. 21(A)). The operation of the first blade 161 is thus restricted to wiping of the first wiping area WA1. The fourth blade 164 has a wiping portion 164A of a wiping dimension WH2 corresponding to the fourth wiping area WA4 (see FIG. 21(D)). The operation of the fourth blade 164 is thus restricted to wiping of the fourth wiping area WA4. Further, the fourth blade 164 includes a side blade 164S for wiping a side surface 30R of the recording head 30. The side blade 164S serving as a side wiping portion has a flat shape and projects from an end of the fourth blade 164.

The second blade 162 has a wiping portion 162C of a wiping dimension WH3 at which the second blade 162 is allowed to wipe the first to fourth wiping areas WA1 to WA4 at one time (see FIG. 21(B)). The second blade 162 has a layered structure in which, for example, a plurality of layers 162A, 162B are bonded together by an adhesive agent. The layers 162A, 162B may be formed of the same material or different materials. That is, for example, the second layer 162B may be formed of nonwoven fabric or porous material, a material relatively hard to deform elastically. Contrastingly, the first layer 162A may be formed of a material relatively easy to deform elastically as compared to the material of the second layer 162B, such as rubber. The second layer 162B is located forward with respect to the movement direction D of the second wiper 152, as compared to the first layer 162A.

The third blade 163 is shaped in such a manner as to wipe the area of the nozzle plate surface 61 other than the areas corresponding to the nozzle opening lines 54A to 54D, or a plurality of interline zones 650 (FIG. 21(C)), at one time. The third blade 163 includes, for example, five interline wiping portions 163A to 163E. The interline wiping portions 163A to 163E are arranged as spaced at equal intervals in a direction perpendicular to the movement direction D of the third wiper 153 (the main scanning direction T). The interline wiping portions 163A to 163E cover the areas between the adjacent ones of the nozzle opening lines 54A to 54D and the areas located outward from the first and fourth nozzle opening lines 54A, 54D, at one time. The wiping portions 161A, 162C, 163A to 163E, and 164A project perpendicular to the movement direction D and the main scanning direction T, or upward as viewed in FIG. 9.

Figure 10:
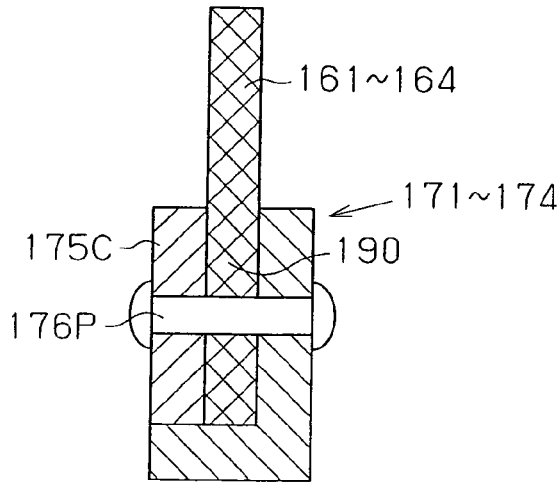
FIG. 10 is a cross-sectional view showing a holding structure of a blade.

Each of the first to fourth blades 161 to 164 is separably secured to a corresponding one of the holder members 171 to 174, which are configured identically. As shown in FIG. 10, each blade 161 to 164 is secured to the corresponding holder member 171 to 174 by means of a cover 175C and a pin 176P. In this state, a base 190 of each blade 161 to 164 is clamped by the cover 175C and the holder member 171 to 174. The holder members 171 to 174 and the cover 175C are formed of, for example, plastic.

Each of the holder members 171 to 174 has an elongated shape so as to hold the corresponding one of the blades 161 to 164. As shown in FIGS. 7 and 8, the holder members 171 to 174 may be arranged in the movement direction D in such a manner that the adjacent ones of the holder members 171 to 174 are held in tight contact with each other. Thus, regardless of the quantity of the wipers 151 to 154, the space for receiving the wipers 151 to 154 may be maximally saved. This minimizes the ink wiper device 130 as a whole.

Referring to FIG. 7, the frame 135 is located at the wiping position WP. After moving from the standby position 18 to the wiping position WP, the carriage 14 and the recording head 30 are located above the frame 135. The recording head 30 is located immediately above the ink suction device 20, when located at the wiping position WP.

When advancing from the standby position 18 to the wiping position WP, the recording head 30 and the carriage 14 move in the main scanning direction T1. In contrast, when retreating from the wiping position WP to the standby position 18, the recording head 30 and the carriage 14 move in the main scanning direction T2.

As shown in FIG. 7, the movement device 138 includes a first lead screw 181, a second lead screw 182, and a driver 140. The movement device 138 moves a selected one (selected ones) of the wipers 151 to 154 that is (are) suitable for desired operation, in the movement direction D. In this manner, the selected wiper device(s) 151 to 154 are allowed to wipe the nozzle plate surface 61. In operation, the movement device 138 successively moves the wipers 151 to 154 in the movement direction D, while maintaining an interval between the adjacent wipers 151 to 154. The wipers 151 to 154 are moved independently from one another in the movement direction D, from the state of FIGS. 7 and 8 in which the adjacent wipers 151 to 154 are held in tight contact with each other in the movement direction D.

The first and second lead screws 181, 182 are arranged between opposing side walls 135A, 135B of the frame 135 and rotationally supported by the side walls 135A, 135B. The lead screws 181, 182 extend in the movement direction D and parallel with each other. The first lead screw 181 corresponds to a first feeder member and the second lead screw 182 corresponds to a second feeder member.

Figure 11:
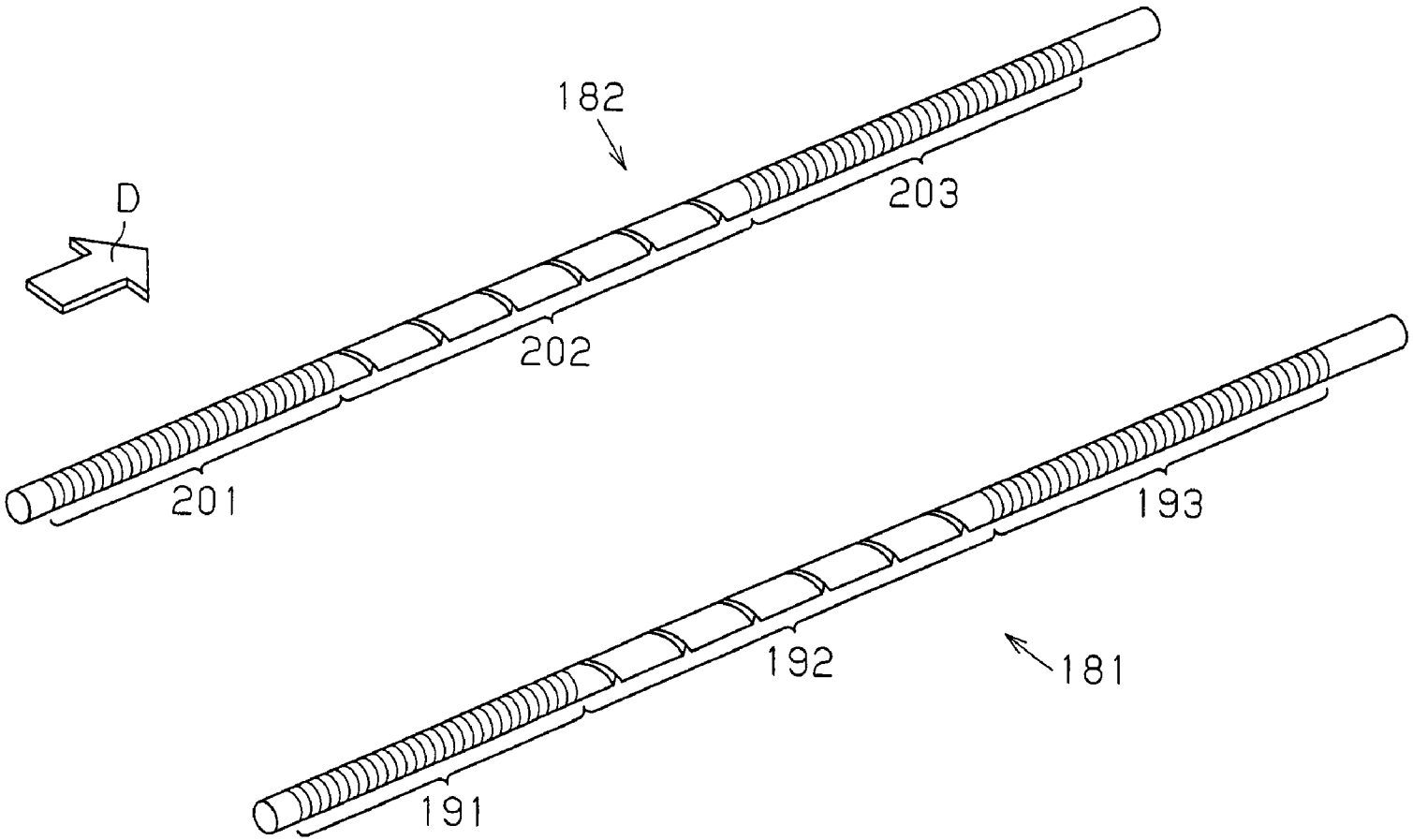
FIG. 11 is a perspective view showing a first lead screw and a second lead screw.

With reference to FIGS. 7 and 11, the structures of the first and second lead screws 181, 182 will hereafter be described. The first and second lead screws 181, 182 are configured identically with each other. The first lead screw 181 includes a pair of first threaded portions 191, 193 and a second threaded portion 192. Likewise, the second lead screw 182 includes a pair of first threaded portions 201, 203 and a second threaded portion 202.

The first threaded portions 191, 193 are arranged at opposing axial sides of the first lead screw 181, or at a front section and a rear section of the lead screw 181 with respect to the movement direction D. Similarly, the first threaded portions 201, 203 are arranged at opposing axial sides of the second lead screw 182, or at a front section and a rear section of the lead screw 182 with respect to the movement direction D. The second threaded portion 192 is formed between the first threaded portions 191, 193, or at a section intermediate between the front section and the rear section of the first lead screw 181. Likewise, the second threaded portion 202 is formed between the first threaded portions 201, 203, or at a section intermediate between the front section and the rear section of the second lead screw 182.

Figures 13A, 13B:
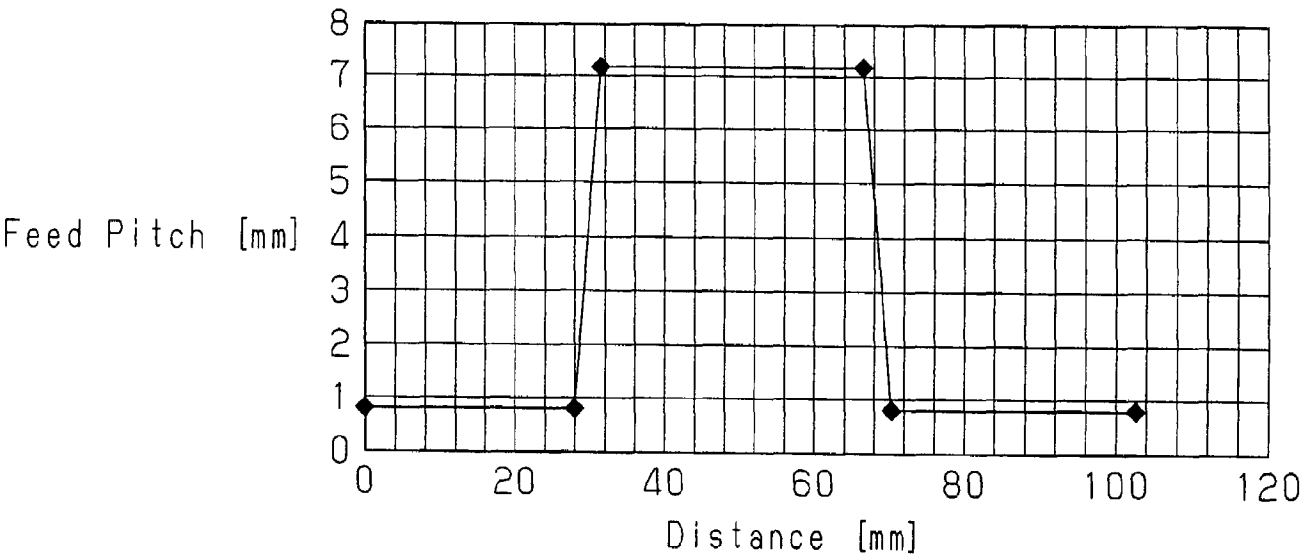
FIG. 13(A) is a table representing the relationship between the axial distance from the spiral base point and the feed pitch in each of the first and second lead screws.
FIG. 13(B) is a graph showing the axial distance from the spiral base point versus the feed pitch in each of the first and second lead screws.

The feed pitch of each first threaded portion 191, 193 (a first feed pitch) is smaller than the feed pitch of the second threaded portion 192 (a second feed pitch). In the same manner, the feed pitch of each first threaded portion 201, 203 (the first feed pitch) is smaller than the feed pitch of the second threaded portion 202 (a second feed pitch). In other words, each of the second threaded portions 192, 202 has a feed pitch greater than the feed pitch of each first threaded portion 191, 193, 201, 203. The feed pitches of the first threaded portions 191, 193, 201, 203 are equal and the feed pitches of the second threaded portions 192, 202 are equal. FIGS. 13(A) and 13(B) each show the relationship between the axial distance from the base point of the spiral and the feed pitch in each of the first and second lead screws 181, 182.

Figure 12:
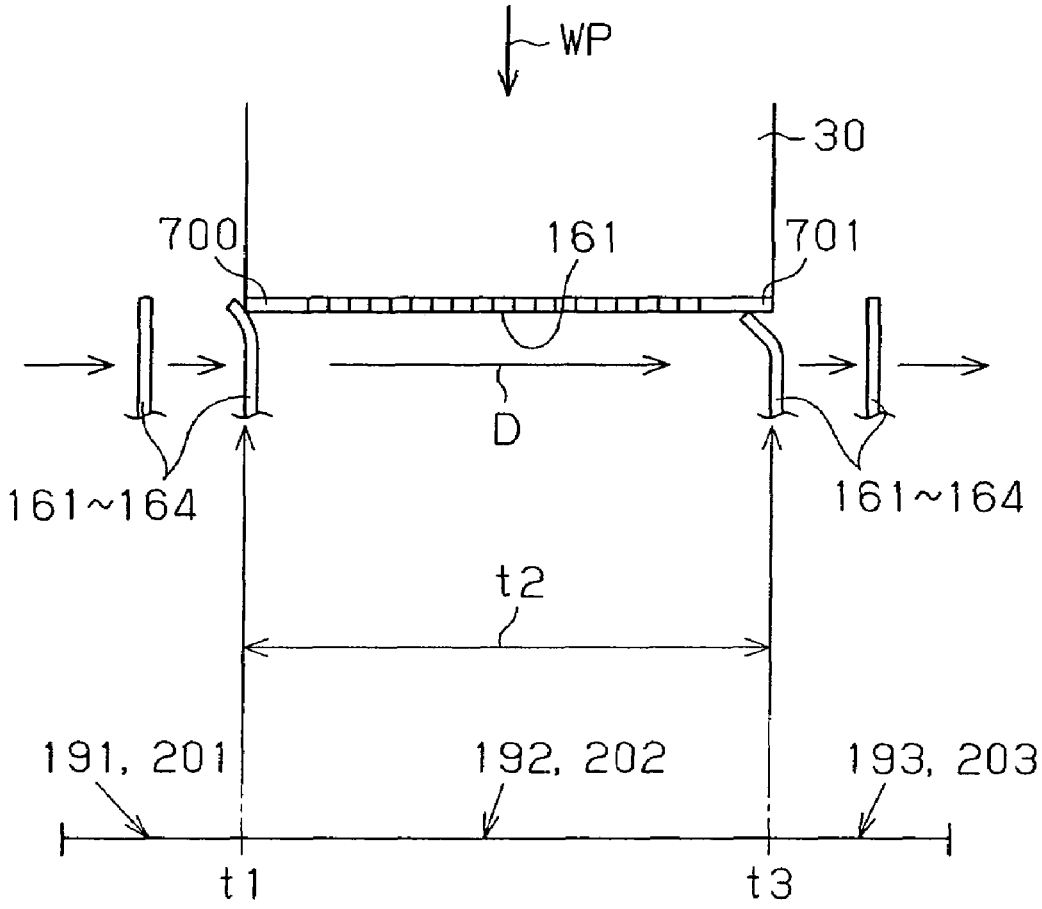
FIG. 12 is a view explaining the operation of the blades with respect to the nozzle plate surface.

As shown in FIG. 12, the nozzle plate surface 61 has a contact start point 700 and a contact end point 701 with respect to the movement direction D. At the contact start point 700, the blades 161 to 164 are brought into contact with the nozzle plate surface 61. At the contact end point 701, the blades 161 to 164 are released from the contact state and start separating from the nozzle plate surface 61. The first threaded portions 191, 201 move the wipers 151 to 154 for moving the blades 161 to 164 from the initial position (the standby position) of FIGS. 7 and 8 to the contact start point 700 of the nozzle plate surface 61 in correspondence with a first non-operational area. The first threaded portions 193, 203 move the wipers 151 to 154 for moving the blades 161 to 164 from the contact end point 701 to a predetermined movement end in correspondence with a second non-operational area.

The second threaded portions 192, 202 move the wipers 151 to 154 for moving the blades 161 to 164 from the contact start point 700 to the contact end point 701 in correspondence with an operational area for wiping the nozzle plate surface 61. In other words, the second threaded portions 192, 202 guide the wipers 151 to 154 in a wiping period t2, or from a wiping start time t1 at which the blades 161 to 164 reach the contact start point 700 to a wiping end time t3 at which the blades 161 to 164 reach the contact end point 701.

Since each of the first threaded portions 191, 201 has a relatively small pitch, the threaded portions 191, 201 move the blades 161 to 164 at a relatively low speed. Thus, the blades 161 to 164 reach the contact start point 700 relatively slowly. If the blades 161 to 164 reach the contact start point 700 relatively quickly, the load acting on each of the blades 161 to 164 is rapidly increased at the contact start point 700. In contrast, if the blades 161 to 164 reach the contact start point 700 relatively slowly, the rapid increase of the load acting on each of the blades 161 to 164 at the contact start point 700 is suppressed. This prevents a power swing of a motor 149 of the driver 140 (see FIG. 7) that drives the lead screws 181, 182.

Since each of the second threaded portions 192, 202 has a relatively great feed pitch, the second threaded portions 192, 202 move the blades 161 to 164 at a relatively high speed. Thus, in the wiping period t2, the blades 161 to 164 wipe the nozzle plate surface 61 while moving relatively quickly. If the blades 161 to 164 move relatively slowly when wiping the nozzle plate surface 61, the blades 161 to 164 may draw the ink from the nozzle openings 55A to 55D. This may damage the meniscus of the ink in the nozzle openings 55A to 55D or increase the quantity of the ink remaining on the nozzle plate surface 61. In contrast, if the blades 161 to 164 move relatively quickly when wiping the nozzle plate surface 61, not only the wiping period t2 is shortened but also the meniscus of the ink in the nozzle openings 55A to 55D is maintained in an optimal state. Further, the nozzle plate surface 61 is wiped effectively.

After reaching the contact end point 701, the blades 161 to 164 are moved by the first threaded portions 193, 203 at a relatively low speed. This maximally suppresses splash of the ink caused by release of the reactive force acting on each blade 161 to 164, when the blade 161 to 164 separates from the contact end point 701.

Figure 14:
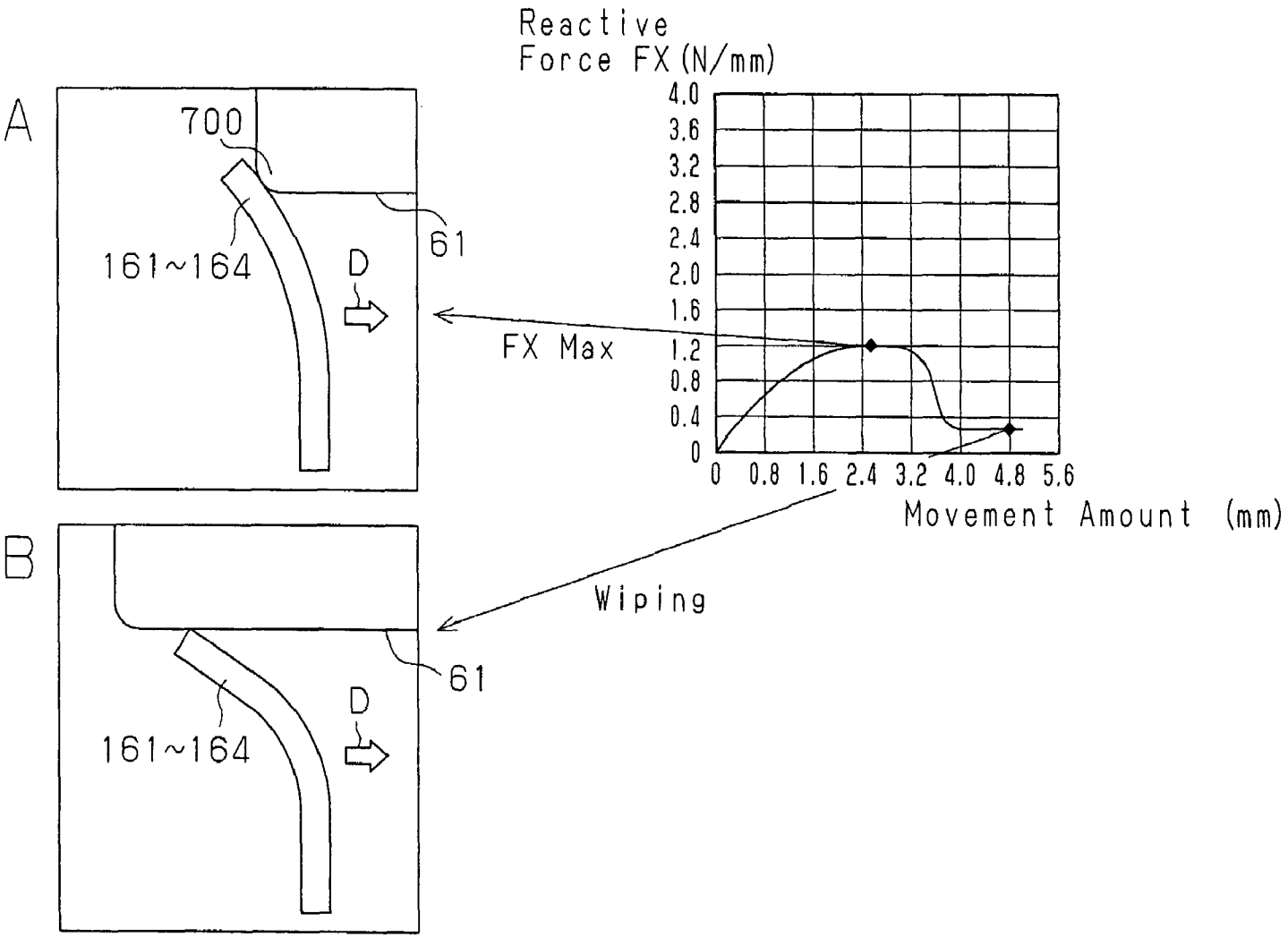
FIG. 14 shows diagrams representing the relationship between the movement amount of each blade and the reactive force acting on the blade.

Referring to FIG. 14, in state A immediately after each blade 161 to 164 is brought into contact with the contact start point 700, the reactive force Fx acting on the blade 161 to 164 is maximized. In state B after the blade 161 to 164 passes the contact start point 700, or a state in which the blade 161 to 164 is wiping the nozzle plate surface 61, the reactive force Fx acting on the blade 161 to 164 is smaller than that of state A. As is indicated by FIG. 14, the reactive force Fx at the contact start point 700 is several times greater than the reactive force Fx acting in the wiping operation.

Referring to FIGS. 7 and 8, the driver 140 operates the first and second lead screws 181, 182 to rotate synchronously. The driver 140 is installed on the side wall 135B of the frame 135.

The driver 140 includes a serrated belt 141, gears 142, 143, 145, 146, 147, 147A, a guide roller 144, a pinion 148, and the motor 149. The motor 149 is driven in response to an instruction of the controller 7. The motor 149 is formed by, for example, a stepping motor.

The serrated belt 141, which is a timing belt, is wound around the gears 142, 143, 145, 146. The guide roller 144 is pressed against the serrated belt 141 from outside so that a predetermined level of tension acts on the serrated belt 141.

The gear 142 is fixed to a rear end of the second lead screw 182. The gear 146 is fixed to a rear end of the first lead screw 181. The rear end of the second lead screw 182 and the rear end of the first lead screw 181 are rotationally supported by the side wall 135B. A front end of the second lead screw 182 and a front end of the first lead screw 181 are rotationally supported by the side wall 135A. The gear 143 is rotationally supported by a support member 150. The gear 145 is rotationally supported by the side wall 135B. The pinion 148 is fixed to the output shaft of the motor 149 and transmits the drive force of the motor 149 to the gear 147 through the gear 147A. The gears 146, 147 are formed integrally.

When the motor 149 runs, the first and second lead screws 181, 182 rotate synchronously in the same directions. Therefore, the holder members 171 to 174 of the wipers 151 to 154 smoothly move in the movement direction D without inclining with respect to the direction D or being dragged by undesired frictional force. The blades 161 to 164 thus proceed in the movement direction D without inclining with respect to the movement direction D.

Figure 15:
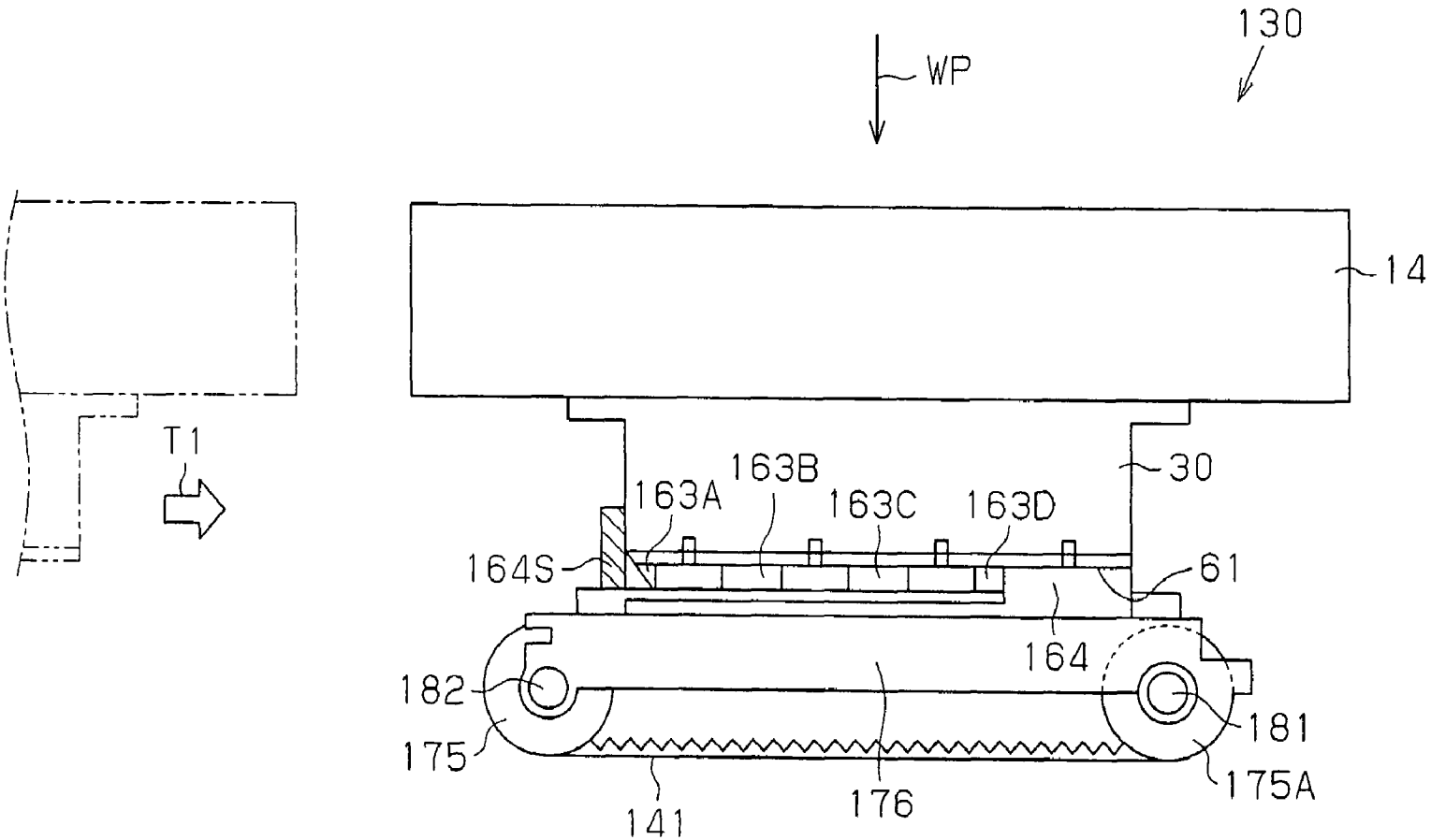
FIG. 15 is a view showing the ink wiper device as viewed in the direction of arrow A1 of FIG. 7.
Figure 16:
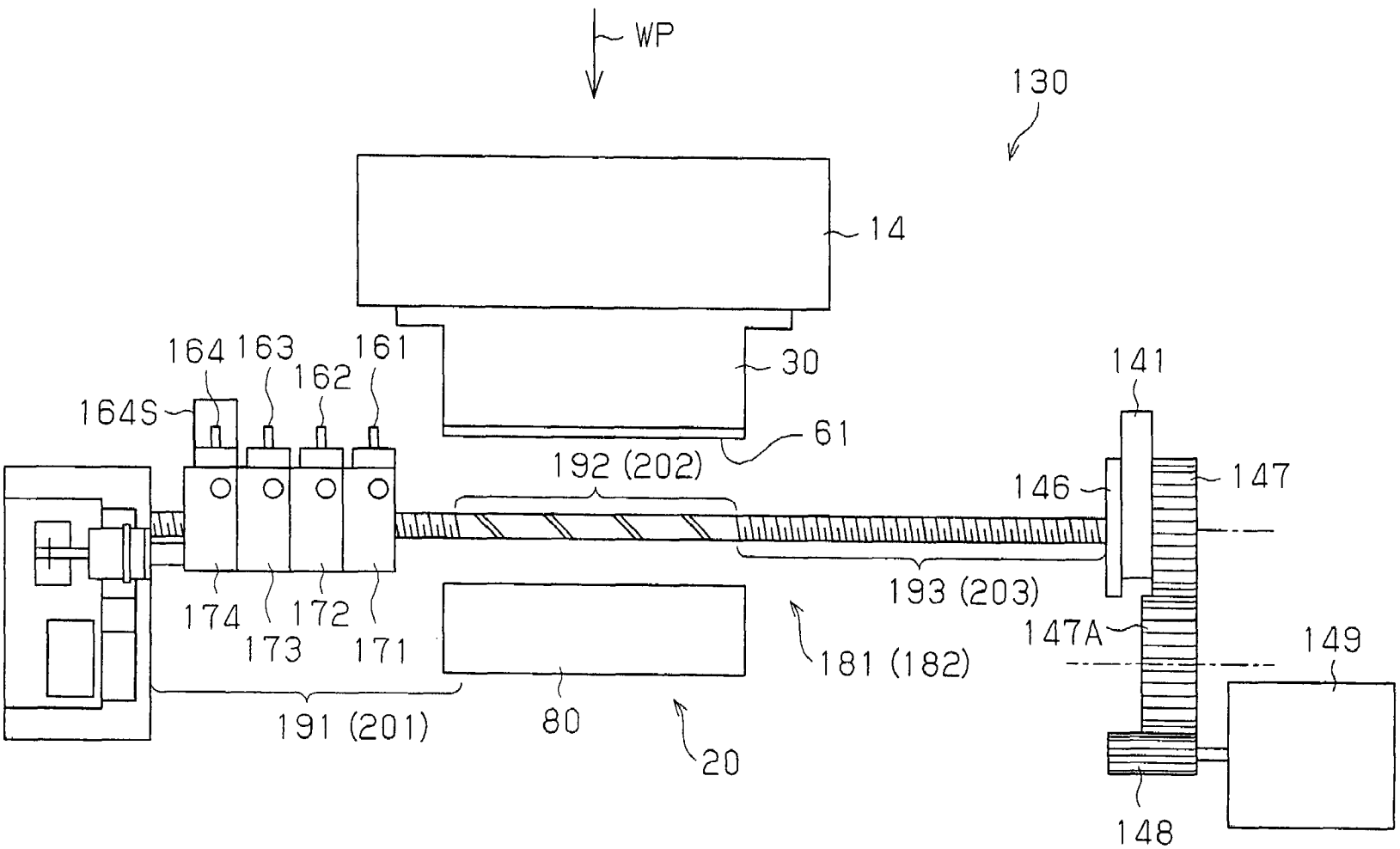
FIG. 16 is a view showing the ink wiper device as viewed in the direction of arrow A2 of FIG. 7.

FIG. 15 shows the ink wiper device 130 as viewed in the direction of arrow A1 of FIG. 7. FIG. 16 shows the ink wiper device 130 as viewed in the direction of arrow A2 of FIG. 7. As shown in FIG. 15, each of the holder members 171 to 174 of the wipers 151 to 154 includes an intermediate section 176 for holding the corresponding blade 161 to 164 and a pair of guide portions 175A, 175. The guide portions 175A, 175 are formed at opposing ends of the intermediate section 176. The first lead screw 181 is passed through the guide portion 175A, and the second lead screw 182 is passed through the guide portion 175.

Figure 17:
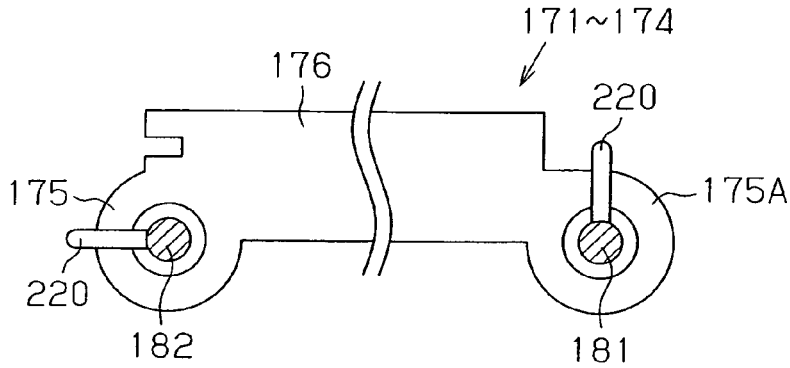
FIG. 17 is a front view showing a structure for connecting a holder member to the first lead screw.
Figure 18:
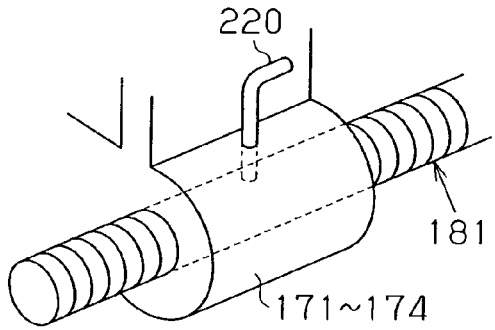
FIG. 18 is a perspective view showing the structure for connecting the holder member to the first lead screw.
Figure 19:
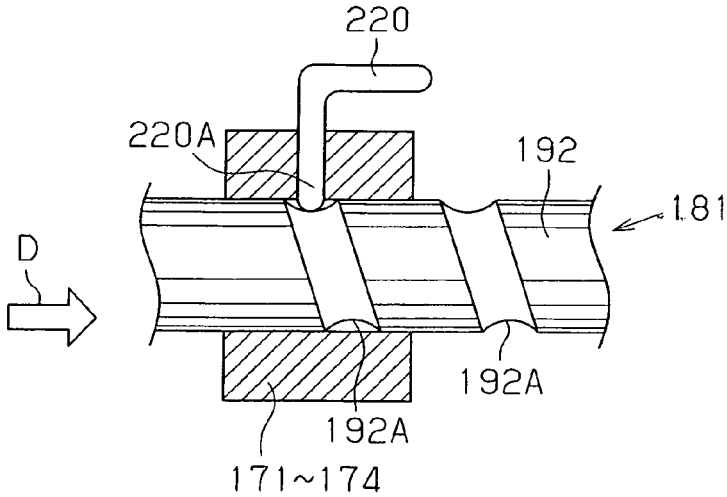
FIG. 19 is a cross-sectional view showing the structure for connecting the holder member to the first lead screw.

As shown in FIGS. 17 and 18, a pin 220 connects each of the guide portions 175A, 175 to the corresponding one of the lead screws 181, 182. More specifically, referring to FIG. 19, a distal end 220A of the pin 220 received in the guide portion 175A is engaged with a threaded groove 192A of the first lead screw 181. Similarly, a distal end of the pin 220 received in the guide portion 175 is engaged with a threaded groove of the second lead screw 182. When the first and second lead screws 181, 182 rotate synchronously, the holder members 171 to 174 linearly move in the movement direction D and an opposite direction to the direction D.

With reference to FIG. 16, with the carriage 14 and the recording head 30 positioned at the wiping position WP, the nozzle plate surface 61 is located above the area between the second threaded portions 192, 202. In this state, the cap body 80 of the ink suction device 20 is located immediately below the nozzle plate surface 61. As shown in FIG. 7, the cap body 80 and the lift device 250 are located below and between the lead screws 181, 182.

The cap body 80 is selectively lifted or lowered by the lift device 250 while moving between the first and second lead screws 181, 182. Since the cap body 80 and the lift device 250 are installed in the ink wiper device 130, the inkjet type printer is minimized.

Figure 20:
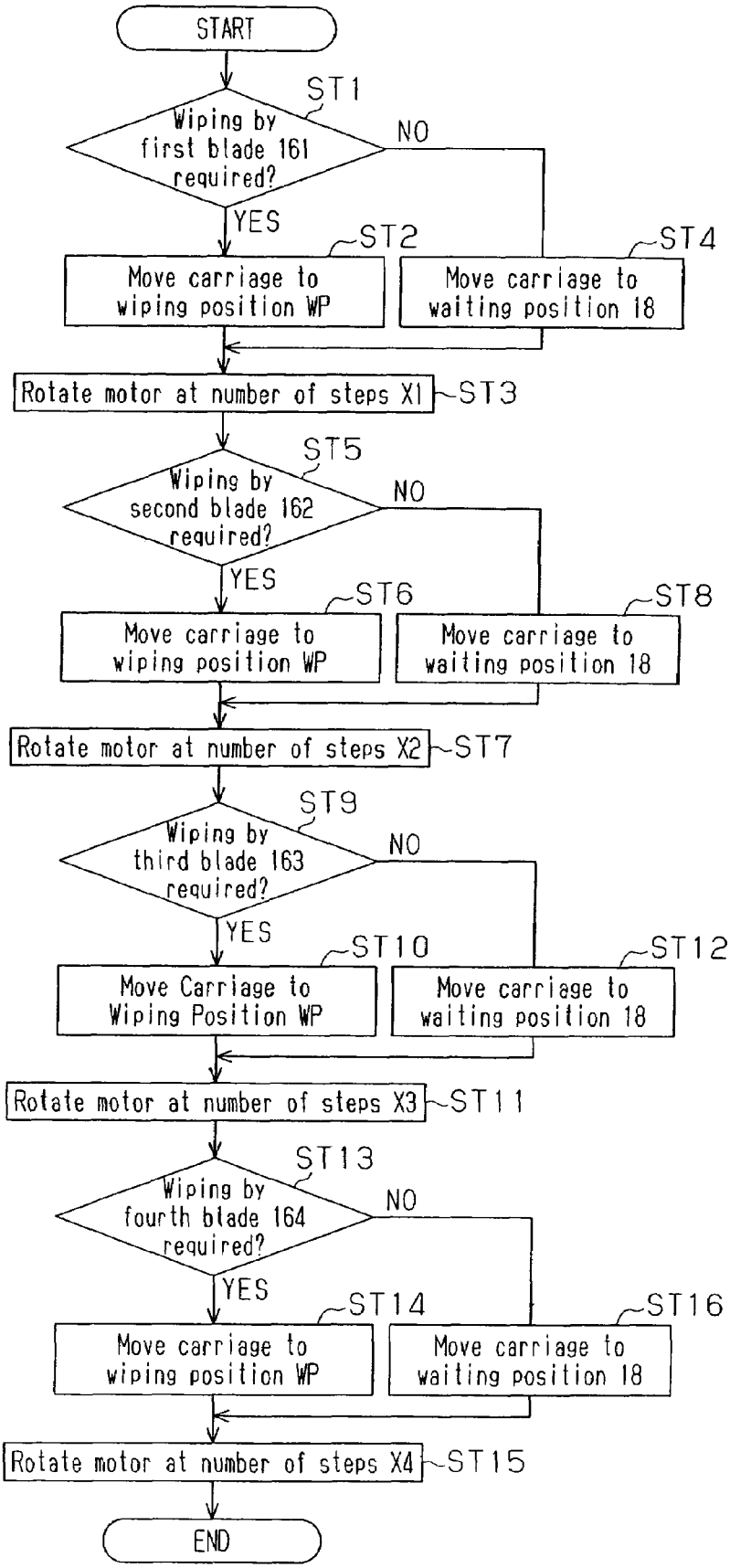
FIG. 20 is a flowchart representing a wiping procedure.

The operation of the ink wiper device 130 will hereafter be explained with reference to FIG. 20. FIG. 20 shows the procedure of the wiping operation performed by the ink wiper device 130. The procedure is executed under control of the controller 7.

Before starting the wiping operation, the nozzle plate surface 61 is subjected to ink suction by the ink suction device 20 of FIGS. 3 and 4, with the carriage 14 and the recording head 30 located at the wiping position WP. The ink suction device 20 is capable of selectively subjecting the four nozzle opening lines 54A to 54D to the ink suction. In other words, by actuating the suction pump 19 and opening at least one of the four open-close valves 85, the nozzle opening line(s) corresponding to the opened open-close valve(s) 85 is (are) subjected to the ink suction.

The wiping operation must be performed on the area of the nozzle plate surface 61 corresponding to the nozzle opening line(s) on which the ink suction has been performed. However, the wiping operation is unnecessary for the remaining area of the nozzle plate surface 61 in which the corresponding nozzle opening lines have not been subjected to the ink suction. For example, if the nozzle opening lines 54A to 54D are all subjected to the ink suction, it is necessary to wipe all of the wiping areas WA1 to WA4, which are shown in FIG. 9. The procedure of the wiping operation executed by the ink wiper device 130 is as follows with reference to FIG. 20.

Before the procedure is started, each of the wipers 151 to 154 is located at the initial position (the standby position) of FIGS. 7 and 8. At this position, the wipers 151 to 154 are held in a state engaged with the first threaded portions 191, 201 and the adjacent one of the wipers 151 to 154 are maintained in tight contact with each other.

For example, if all of the wiping areas WA1 to WA4 of the nozzle plate surface 61 are to be wiped as illustrated in FIG. 21(B), the second blade 162 is selected for the wiping operation. The first, third, or fourth blades 161, 163, 164 are not used in the operation.

That is, in step ST1 of FIG. 20, it is determined that wiping by the first blade 161 is not required. Thus, in step ST4, the carriage 14 and the recording head 30 are moved from the wiping position WP to the standby position 18. Then, in step ST3, the motor 149 is rotated at a predetermined number of steps X1, so that the first wiper 151 moves in the movement direction D without performing the wiping operation.

Figure 22:
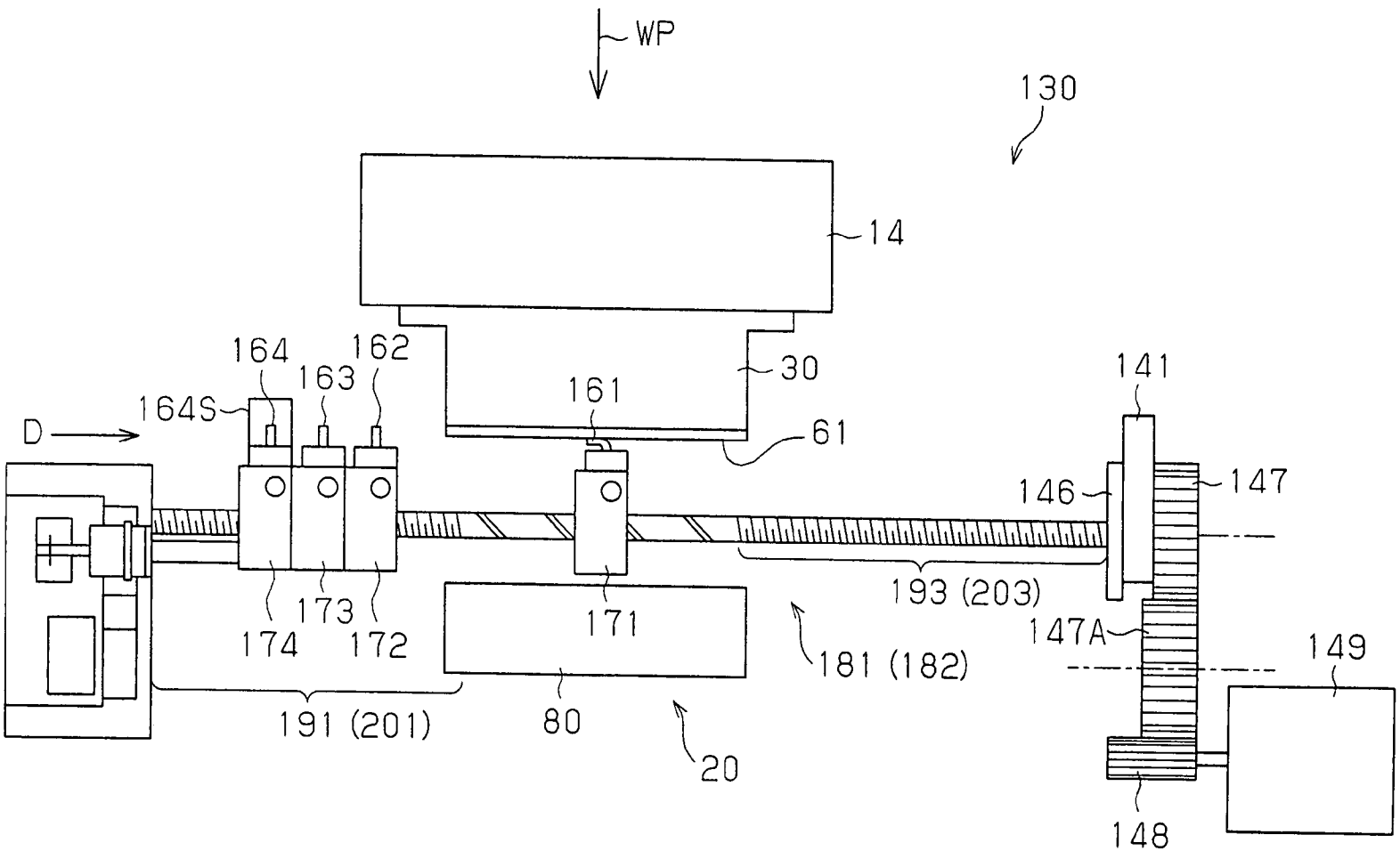
FIG. 22 is a view corresponding to FIG. 16 for explaining the operation of the blades.

In this case, the wipers 151 to 154 start to move from the standby position in the movement direction D, at the same time. As shown in FIG. 22, the first wiper 151, or the most preceding wiper, is passed from the first threaded portions 191, 201 to the second threaded portions 192, 202, prior to the other wipers 152 to 154. The first wiper 151 then proceeds in the movement direction D at a speed higher than the speed at which the second to third wipers 152 to 154 are moving. The first wiper 151 is then passed from the second threaded portions 192, 202 to the first threaded portions 193, 203. In other words, the first wiper 151, or a most preceding wiper, is moved in the movement direction D by the second threaded portions 192, 202, each of which has the relatively great feed pitch, at a speed higher than the speed of the succeeding, second wiper 152. The interval between the first wiper 151 and the second wiper 152 is thus increased.

Next, in step ST5 of FIG. 20, it is determined that the entire portion of the nozzle plate surface 61 must be subjected to wiping by the second blade 162. Then, in step ST6, the carriage 14 and the recording head 30 are moved from the standby position 18 to the wiping position WP. In the subsequent step ST7, the motor 149 is rotated at a predetermined number of steps X2, allowing the second wiper 152 to proceed in the movement direction D while wiping all of the wiping areas WA1 to WA4 of the nozzle plate surface 61.

Subsequently, in step ST9, it is determined that wiping by the third blade 163 is not required, and step ST12 is executed. In step ST12, the carriage 14 and the recording head 30 are returned from the wiping position WP to the standby position 18. Then, in step ST11, the motor 149 is rotated at a predetermined number of steps X3, allowing the third wiper 153 to proceed in the movement direction D without performing the wiping.

Next, in step ST13, it is determined that wiping by the fourth blade 164 is not required, and step ST16 is executed. In step ST16, the carriage 14 and the recording head 30 are to be moved to the standby position 18. However, since the carriage 14 and the recording head 30 have already been moved to the standby position 18 in step ST12, the carriage 14 and the recording head 30 are simply maintained at the standby position 18 in step ST16. Then, in step ST15, the motor 149 is rotated at a predetermined number of steps X4, allowing the fourth wiper 154 to proceed in the movement direction D without performing the wiping.

In the above-described manner, the entire portion of the nozzle plate surface 61 is subjected to the wiping operation using the second blade 162 selectively.

If the first and fourth wiping areas WA1, WA4 and the side surface 30R of the recording head 30 are to be wiped by the first and fourth blades 161, 164, as illustrated in FIGS. 21(A) and 21(D), the wiping operation is performed in the following manner. The second or third blades 162, 163 are not used in the operation.

In step ST1 of FIG. 20, it is determined that the wiping by the first blade 161 is required. Then, in step ST2, the carriage 14 and the recording head 30 are maintained at the wiping position W. In the subsequent step ST3, the motor 149 is rotated at the number of steps X1, allowing the first wiper 151 to proceed in the movement direction D while wiping the first wiping area WA1.

Next, in step ST5, it is determined that the wiping by the second blade 162 is not required, and step ST8 is executed. In step ST8, the carriage 14 and the recording head 30 are returned from the wiping position WP to the standby position 18. Then, in step ST7, the motor 149 is rotated at the number of steps X2, allowing the second wiper 152 to proceed in the movement direction D without performing the wiping.

Further, in step ST9, it is determined that the wiping by the third blade 163 is not required, and step ST12 is executed. In step ST12, the carriage 14 and the recording head 30 are maintained at the standby position 18. Then, in step ST11, the motor 149 is rotated at the number of steps X3, allowing the third wiper 153 to proceed in the movement direction D without performing the wiping.

Subsequently, in step ST13, it is determined that the wiping by the fourth blade 164 is required. Then, in step ST14, the carriage 14 and the recording head 30 are moved from the standby position 18 to the wiping position W. In the subsequent step ST15, the motor 149 is rotated at the number of steps X4, allowing the fourth wiper 154 to proceed in the movement direction D while wiping the first wiping area WA4 and the side surface 30R of the recording head 30.

In this manner, the first and fourth wiping areas WA1, WA4 and the side surface 30R are wiped by the first and fourth blades 161, 164.

Figure 21:
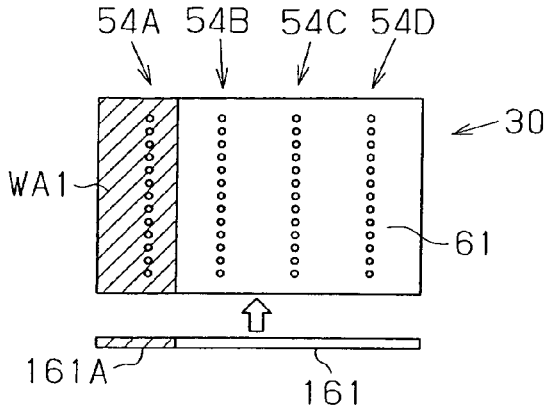
FIGS. 21(A) to 21(D) are views explaining the wiping areas in correspondence with each of the blades.
Figure 21:
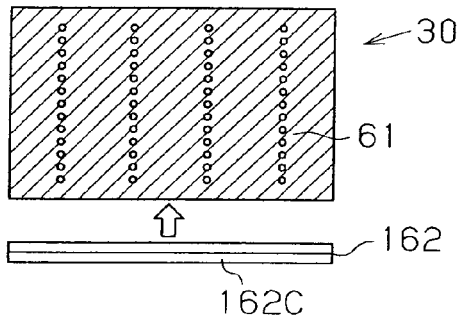
Figure 21:
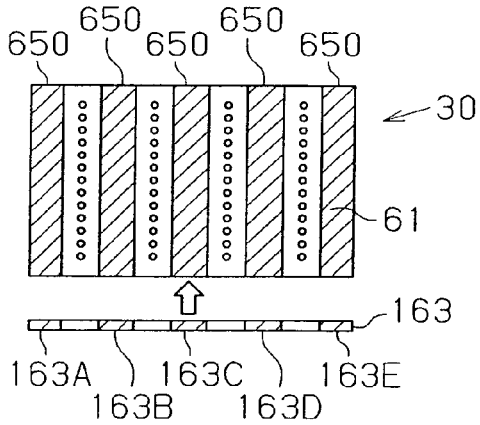
Figure 21:
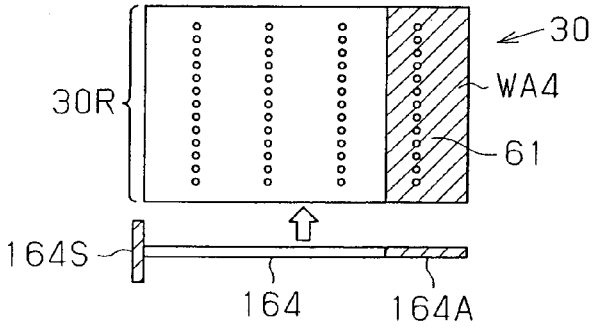

When wiping the interline zones 650 of the nozzle plate surface 61 at one time by the third blade 163, referring to FIG. 21(*c*), the wiping operation is performed in the following manner. The blades 161, 162, 164 other than the third blade 163 are not used in the operation.

In step ST1 of FIG. 20, it is determined that the wiping by the first blade 161 is not required, and step ST4 is executed. In step ST4, the carriage 14 and the recording head 30 are moved from the wiping position WP to the standby position 18. Then, in step ST3, the motor 149 is rotated at the number of steps X1, allowing the first wiper 151 to proceed in the movement direction D without performing the wiping.

Next, in step ST5, it is determined that the wiping by the second blade 162 is not required, and step ST8 is executed. In step ST8, the carriage 14 and the recording head 30 are maintained at the standby position 18. Then, in step ST7, the motor 149 is rotated at the number of steps X2, allowing the second wiper 152 to proceed in the movement direction D without performing the wiping.

Subsequently, in step ST9, it is determined that the wiping by the third blade 163 is required. Then, in step ST10, the carriage 14 and the recording head 30 are moved from the standby position 18 to the wiping position W. In the next step ST11, the motor 149 is rotated at the number of steps X3, allowing the third wiper 153 to proceed in the movement direction D while wiping the interline zones 650 of the nozzle plate surface 61 by means of the interline wiping portions 163A to 163E, at one time (see FIG. 21(C)).

Further, in step ST13, it is determined that the wiping by the fourth blade 164 is not required, and step ST16 is executed. In step ST16, the carriage 14 and the recording head 30 are moved from the wiping position WP to the standby position 18. Then, in step ST15, the motor 149 is rotated at the number of steps X4, allowing the fourth wiper 154 to proceed in the movement direction D without performing the wiping.

As a result, the interline zones 650 of the nozzle plate surface 61 are reliably wiped by the third blade 163, with reference to FIG. 21(C).

The wiping operation by the ink wiper device 130 is not restricted to the above-described examples. That is, the procedure of the wiping operation may be used for any mode of wiping, which may be wiping by the first and third blades 161, 163, wiping by the second and fourth blades 162, 164, or wiping by only one of the first and fourth blades 161, 164.

When the first and second lead screws 181, 182, which are identically shaped, rotate synchronously, the multiple, different types of wipers 151 to 154 are successively moved in the movement direction D while maintaining an interval between the adjacent wipers 151 to 154. For allowing each of the blades 161 to 164 to reach the contact start point 700 of the nozzle plate surface 61, as shown in FIG. 12, the first threaded portions 191, 201 each having the relatively small feed pitch move the blade 161 to 164 at a relatively low speed. This suppresses the load (the reactive force) acting on the blade 161 to 164 when the blade 161 to 164 reaches the contact start point 700.

Likewise, for separating each blade 161 to 164 from the contact end point 701 of the nozzle plate surface 61, the first threaded portions 193, 203 each having the relatively small pitch move the blade 161 to 164 at a relatively low speed. This suppresses the ink splash caused by the separation between the blade 161 to 164 and the nozzle plate surface 61.

However, in the wiping period t2, the second threaded portions 192, 202 each having the relatively great feed pitch move each of the blades 161 to 164 at a relatively high speed. Thus, the blades 161 to 164 are allowed to wipe the nozzle plate surface 61 relatively quickly, without damaging the meniscus of the ink in the nozzle openings 55A to 55D, while maximally preventing the ink from remaining on the nozzle plate surface 61.

By gradually changing the feed pitch of each lead screw 181, 182, the wipers 151 to 154 can be moved smoothly in the movement direction D, thus suppressing a rapid change of the load acting on each wiper 151 to 154. Further, by retarding operation of the first threaded portions 191, 201, 193, 203, each having the relatively small feed pitch, with respect to operation of the other components, such as the capping operation of the ink suction device 20 and the actuation of the valves, the threaded portions 191, 201, 193, 203 and the other components may be operated at optimal timings.

Figure 23:
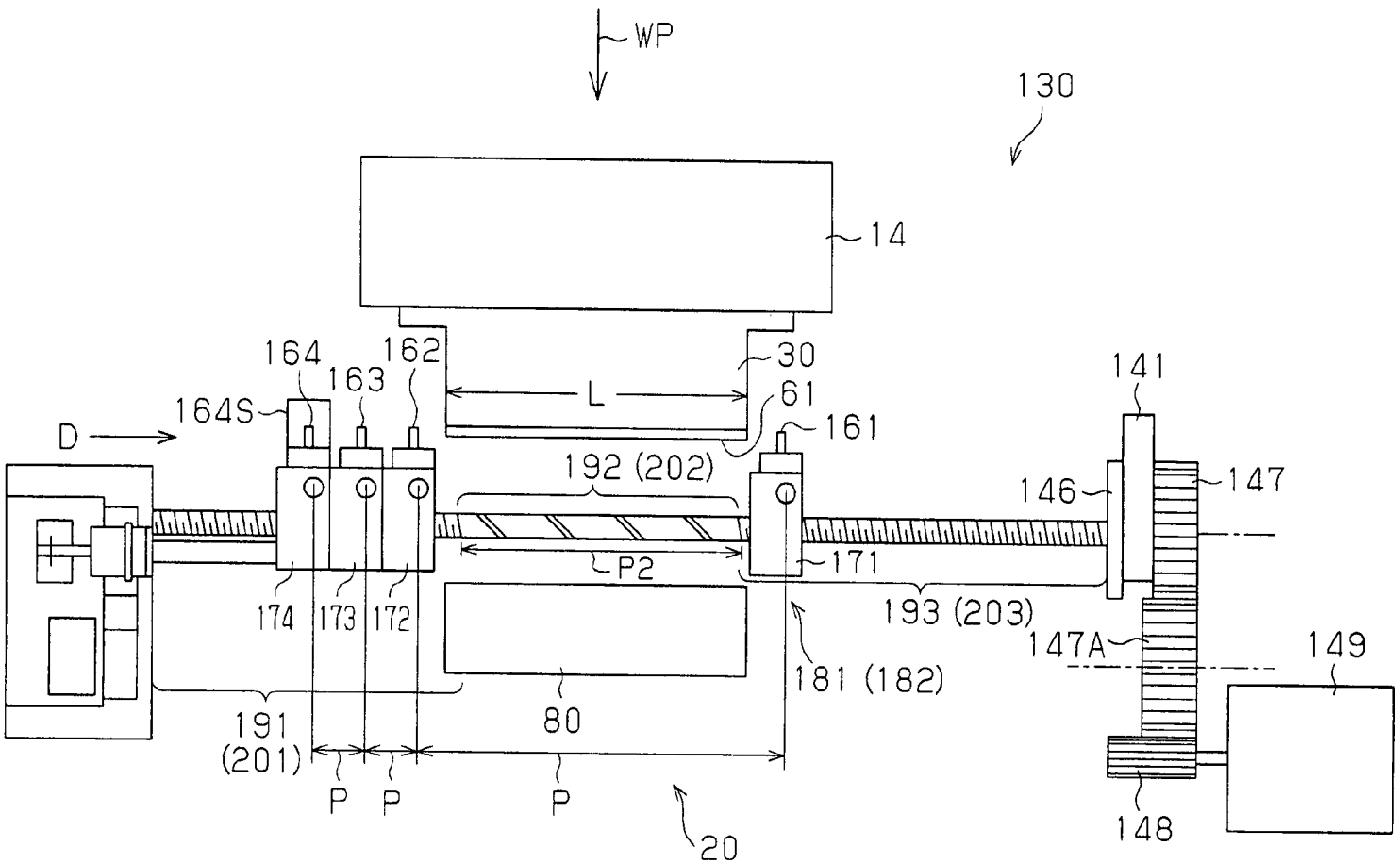
FIG. 23 is a view corresponding to FIG. 16 for explaining the operation of the blades.

In the illustrated embodiment, as shown in FIG. 23, after the nozzle plate surface 61 is wiped by a preceding one of the wipers 151 to 154, the succeeding one of the wipers 151 to 154 is allowed to start wiping the nozzle plate surface 61. That is, in the ink wiper device 130, the wipers 151 to 154 are allowed to wipe the nozzle plate surface 61 independently from one another. In other words, when one of the wipers 151 to 154 wipes the nozzle plate surface 61 as moved by the second threaded portions 192, 202, the other ones of the wipers 151 to 154 are located outside the area of the nozzle plate surface 61 that may be wiped by the wipers 151 to 154 (the operational area).

As shown in FIG. 23, the wipers 151 to 154 are engaged with the lead screws 181, 182 in such a manner to define a uniform number P of pitches between the adjacent ones of the wipers 151 to 154. In other words, in the illustrated embodiment, since the feed pitch of each first threaded portion of the lead screws 181, 182 is different from the feed pitch of each second threaded portion, the interval between the adjacent wipers is variable. However, the number P of the pitches between the adjacent wipers is maintained constant and uniform throughout each lead screw 181, 182. More specifically, the number P of the pitches between the adjacent wipers corresponds to the number P of the pitches between two points of each lead screw 181, 182 at which the corresponding pins 220 (see FIG. 19) of the adjacent wipers are engaged with the lead screw 181, 182.

As has been described, in the illustrated embodiment, each of the wipers 151 to 154 is engaged with the first threaded portions 191, 201 when reaching the contact start point 700 of the nozzle plate surface 61. Further, each wiper 151 to 154 is engaged with the first threaded portions 192, 203 when separating from the contact end point 701 of the nozzle plate surface 61. Thus, the number P2 of the pitches defined by each of the second threaded portions 192, 202 is equal to or smaller than the number P of the pitches between the adjacent wipers.

Further, the number of the pitches between the point of each lead screw 181, 182 at which each wiper 151 to 154 is engaged with the lead screw 181, 182 when starting to contact the nozzle plate surface 61 and the point of the lead screw 181, 182 at which the wiper 151 to 154 is engaged with the lead screw 181, 182 when starting to separate from the nozzle plate surface 61 is equal to or smaller than the number P of the pitches between the adjacent wipers. In other words, the pitches of the section of each lead screw 181, 182 corresponding to the recording head 30 (the nozzle plate surface 61) of length L with respect to the movement direction D is equal to or smaller than the number P of the pitches between the adjacent wipers. Accordingly, only after a preceding one of the wipers (the first wiper 151 in FIG. 23) completes wiping of the nozzle plate surface 61, the succeeding wiper (the second wiper 152 in FIG. 23) is allowed to start wiping the nozzle plate surface 61.

If the pitch number P is equal to the number of the pitches of the section of each lead screw 181, 182 corresponding to the recording head 30 with respect to the movement direction D, the adjacent ones of the wipers 151 to 154 are held in tight contact with each other before and after the wiping. The space occupied by the wipers 151 to 154 is thus minimized.

However, if the pitch number P is greater than the number of the pitches of the section of each lead screw 181, 182 corresponding to the recording head 30 with respect to the movement direction D, a time lag is caused between when a preceding one of the wipers completes the wiping of the nozzle plate surface 61 and when the succeeding wiper starts wiping the nozzle plate surface 61. Thus, even with the motor 149 driven continuously until the movement of the wipers 151 to 154 is completed, the carriage 14 may be operated. In other words, in the above-described case in which only the first and fourth wiping areas WA1, WA4 are wiped, for example, the first blade 161 is moved for wiping the first wiping area WA1 with the recording head 30 located at the wiping position WP. Afterwards, before the second blade 162 reaches the recording head 30, the recording head 30 is moved from the wiping position WP to the standby position 18. In this state, the second and third blades 162, 163 successively pass the operational area corresponding to the wiping position WP without wiping the nozzle plate surface 61. Then, before the fourth blade 164 reaches the recording head 30, the recording head 30 is returned from the standby position 18 to the wiping position WP. In this state, the fourth blade 164 is operated for wiping the fourth wiping area WA4. In this manner, the nozzle plate surface 61 can be wiped without temporarily stopping the motor 149.

In the illustrated embodiment, as shown in FIG. 9, the wipers 151 to 154 are formed by the different types of wipers, or the blades 161 to 164 are shaped differently from one another. Therefore, the wipers 151 to 154 for wiping the nozzle plate surface 61 are selectable. Before the selected wiper enters the operational area corresponding to the wiping position WP, the carriage 14 and the recording head 30 are moved to the wiping position WP. In contrast, the carriage 14 and the recording head 30 are retreated to the standby position 18 before the wiper different than the selected one enters the operational area corresponding to the wiping position WP.

By slightly shifting the carriage 14 and the recording head 30 in the main scanning direction T by a predetermined amount, the area of the nozzle plate surface 61 wiped by each blade can be changed. That is, for example, any one of the second to fourth wiping areas WA2 to WA4 may be wiped by the first blade 161 of FIG. 9.

Particularly, in the illustrated embodiment, the ink suction device 20 is capable of performing the ink suction selectively with respect to the nozzle opening lines 54A to 54D. Therefore, the wiping operation may be required for either the entire portion of the nozzle plate surface 61 or a restricted portion of the nozzle plate surface 61. The ink wiper device 130 of the illustrated embodiment is capable of wiping only the area of the nozzle plate surface 61 that requires wiping, through the selective use of the wipers 151 to 154. The ink wiper device 130 is thus preferably used in the inkjet printer 10, which has the ink suction device 20. Also, only the wiping area of the nozzle plate surface 61 corresponding to any one of the nozzle opening lines 54A to 54D can be subjected to the wiping operation. This makes it easy to use so-called reactive ink.

Each of the wipers 151 to 154 has the corresponding holder member 171 to 174, which has a relatively small thickness. The wipers 151 to 154 are thus held in tight contact with the adjacent wipers 151 to 154 in the movement direction D. Thus, even if the wipers are provided in an increased quantity, the quantity of the wipers aligned in the movement direction D can be increased without enlarging the ink wiper device 130. Further, the wipers 151 to 154 are arranged between the two lead screws 181, 182. This arrangement reduces the size of the ink wiper device 130 and simplifies the structure of the ink wiper device 130. Accordingly, the size of the inkjet printer 10 may be reduced and the structure of the inkjet printer 10 may be simplified as a whole.

By forming the blades 161 to 164 of different materials and in different shapes, the wiping operation may be performed in various manners suitable for a current requirement. For example, if the blades 161 to 164 are formed of different rubber materials, the blades 161 to 164 positively differ from one another in terms of anti-ink resistance and length of life. Alternatively, if the blades 161 to 164 differ from one another in terms of hardness or thickness or dimension perpendicular to the nozzle plate surface 61, the blades 161 to 164 apply different levels of wiping pressure to the nozzle plate surface 61 when wiping the nozzle plate surface 61. Further, if the blades 161 to 164 are formed of felt material, the blades 161 to 164 rub the nozzle plate surface 61 (in a wet-cloth-like manner). Also, if the gap between the nozzle plate surface 61 and the platen 12, or the height of the nozzle plate surface 61, is variable, the pressing force of the blades 161 to 164 acting on the nozzle plate surface 61 can be varied. These alternatives may be effective if the wiping performance must be changed depending on the ink elements or the wiping force must be changed depending on a current deterioration state of the nozzle plate surface 61. Accordingly, if wiping can be performed by selecting from multiple types of blades when the wiping by a single type of blades is insufficient, the nozzle plate surface 61 can be wiped effectively.

As an example of the case in which different types of blades are employed, the third blade 163 of FIG. 9 will be discussed. As has been described, the third blade 163 has the interline wiping portions 163A to 163E. By wiping the nozzle plate surface 61 using the third blade 163, the ink remaining on the nozzle plate surface 61, a so-called cap mark, can be removed without damaging the nozzle openings of the nozzle openings lines 54A to 54D. More specifically, as shown in FIG. 4, an upper end 97 of the cap body 80 is pressed against the nozzle plate surface 61 during the ink suction by the ink suction device 20. After the cap body 80 separates from the nozzle plate surface 61, the ink may remain as the cap mark on the portion of the nozzle plate surface 61 corresponding to the upper end 97. However, in the illustrated embodiment, the cap mark can be reliably wiped off by the interline wiping portions 163A to 163E of the third blade 163.

The fourth blade 164 of FIG. 9 has the side blade 164S. Using the side blade 164S, the ink can be reliably removed from the side surface of the recording head 30.

In the illustrated embodiment, the different types of wipers 151 to 154 are allowed to move in the movement direction D with respect to the nozzle plate surface 61 independently from one another. That is, unlike the conventional art, it is unnecessary to rotate the blades for positioning the blades. The ink wiper device 130 thus can be reduced in size and the space occupied by the ink wiper device 130 can be saved. In particular, the vertical dimension of the ink wiper device 130 perpendicular to the movement direction D becomes relatively small, as compared to the conventional rotating blade type apparatus. The inkjet printer 10 is thus reduced in size.

In the illustrated embodiment, the wipers 151 to 154 can be moved by the single motor 149 independently from one another, without interfering with one another. In other words, the multiple wipers 151 to 154 are moved independently from one another by the motor 149 and the lead screws 181, 182, each of which is provided in the quantity smaller than the quantity of the wipers 151 to 154. This structure simplifies the structure of the mechanism for moving the wipers 151 to 154 and minimizes the mechanism.

Figure 24:
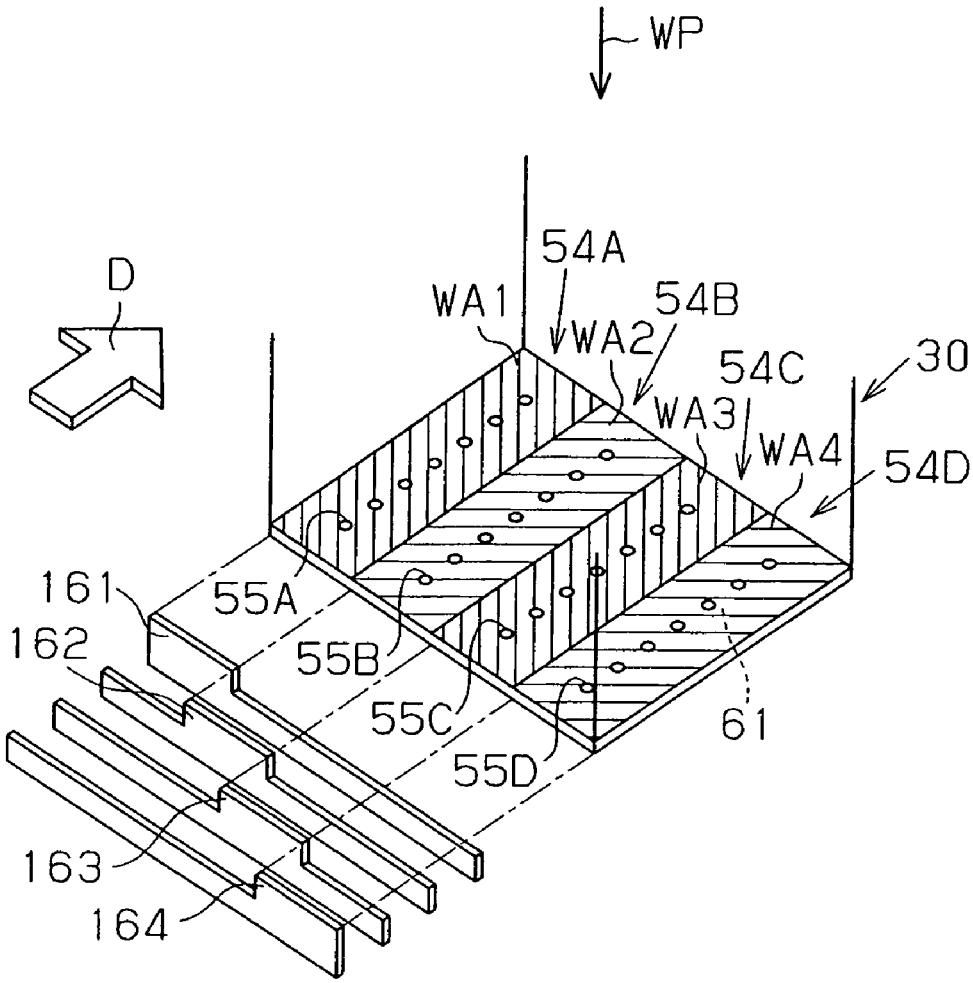
FIG. 24 is a perspective view showing another embodiment of the present invention.

FIG. 24 shows another embodiment of the present invention. This embodiment is identical to the embodiment of FIGS. 1 to 23 except for the fact that the second blades 162 to 164 of FIG. 24 are different from the corresponding ones of FIG. 9. Thus, the embodiment of FIG. 24 will be explained also referring to FIGS. 1 to 23, as necessary.

As shown in FIG. 24, the first-to fourth blades 161 to 164 are formed by different types of blades. More specifically, the first to fourth blades 161 to 164 are shaped differently from one another but formed of the same material. However, alternatively, the first to fourth blades 161 to 164 may be formed of different materials. The different materials may include materials different from one another in terms of pressing force applied to the nozzle plate surface 61. The different materials may also include material that rubs the nozzle plate surface 61 in a wet-cloth-like manner.

Each of the first to fourth blades 161 to 164 is shaped in correspondence with the corresponding one of the first to fourth wiping areas WA1 to WA4 of the nozzle plate surface 61. That is, the first blade 161 has a wiping portion 161A for wiping the first wiping area WA1. The second blade 162 has a wiping portion 162D for wiping the second wiping area WA2. The third blade 163 has a wiping portion 163F for wiping the third wiping area WA3. The fourth blade 164 has a wiping portion 164A for wiping the fourth wiping area WA4.

The four wiping portions 161A, 162D, 163F, 164A are arranged at offset positions with respect to one another in the main scanning direction T, which is perpendicular to the movement direction D. In this manner, the positions of the wiping portions 161A, 162D, 163F, 164A correspond to the positions of the corresponding, first to fourth wiping areas WA1 to WA4. However, for compensating errors of fabrication or installation of the components, it is preferred that the adjacent ones of the wiping portions are arranged in a manner partially overlapping with each other in the main scanning direction T. In this case, the areas of the nozzle plate surface 61 corresponding to the adjacent wiping portions partially overlap with each other. This reliably prevents a non-wiped area from being caused between the areas of the nozzle plate surface 61 wiped by the adjacent wiping portions, regardless of the fabrication or installation errors of the components.

In the embodiment of FIG. 24, by using the first to fourth wipers 151 to 154 selectively, any one of the nozzle opening lines of the nozzle plate surface 61 may be wiped selectively. In other words, using one or more of the first to fourth blades 161 to 164, one or more of the first to fourth wiping areas WA1 to WA4 may be subjected to wiping as desired.

The procedure of the wiping operation by the ink wiper device 130 will hereafter be explained with reference to FIG. 20. Prior to the operation, the carriage 14 and the recording head 30 are moved to the wiping position WP. Further, the wipers 151 to 154 are located at the initial position (the standby position) of FIGS. 7 and 8, or engaged with the first threaded portions 191, 201 in such a manner that the adjacent ones of the wipers 151 to 154 are held in tight contact with each other.

If all of the first to fourth wiping areas WA1 to WA4 of the nozzle plate surface 61 are to be wiped, the wiping operation is performed according to the following procedure. First, in step ST1 of FIG. 20, it is determined that wiping by the first blade 161 is required. Thus, in step ST2, the carriage 14 and the recording head 30 are maintained at the wiping position WP. In the subsequent step ST3, the motor 149 is rotated at the number of steps X1, so that the first wiper 151 moves in the movement direction D while wiping the first wiping area WA1.

Then, in step ST5, it is determined that wiping by the second blade 162 is required. Thus, in step ST6, the carriage 14 and the recording head 30 are maintained at the wiping position WP. In the subsequent step ST7, the motor 149 is rotated at the number of steps X2, so that the second wiper 152 moves in the movement direction D while wiping the second wiping area WA2.

Next, in step ST9, it is determined that wiping by the third blade 163 is required. Thus, in step ST10, the carriage 14 and the recording head 30 are maintained at the wiping position WP. In the subsequent step ST11, the motor 149 is rotated at the number of steps X3, so that the third wiper 153 moves in the movement direction D while wiping the third wiping area WA3.

Subsequently, in step ST13, it is determined that wiping by the fourth blade 164 is required. Thus, in step ST14, the carriage 14 and the recording head 30 are maintained at the wiping position WP. In the subsequent step ST15, the motor 149 is rotated at the number of steps X4, so that the fourth wiper 154 moves in the movement direction D while wiping the fourth wiping area WA4.

In this manner, all of the wiping areas WA1 to WA4 are wiped successively by the corresponding, first to fourth blades 161 to 164, which move in the movement direction D. For wiping the first to fourth wiping areas WA1 to WA4 successively, the motor 149 is actuated continuously without being stopped, so that the first to fourth blades 161 to 164 are moved successively. In this case, since each of the first threaded portions has a pitch different from that of each of the second threaded portions, the speed at which the lead screws 181, 182 move the wipers 151 to 154 are changed. Therefore, the speed of the motor 149 does not have to be changed, or the motor 149 may be driven at a constant speed.

If the first and third wiping areas WA1, WA3 of the nozzle plate surface 61 are to be wiped but not the second and fourth wiping areas WA2, WA4, the wiping operation is performed in accordance with the following procedure. First, in step ST1 of FIG. 20, it is determined that the wiping by the first blade 161 is required. Thus, in step ST2, the carriage 14 and the recording head 30 are maintained at the wiping position WP. In the subsequent step ST3, the motor 149 is rotated at the number of steps X1, so that the first wiper 151 moves in the movement direction D while wiping the first wiping area WA1.

Then, in step ST5, it is determined that the wiping by the second blade 162 is not required. Thus, in step ST8, the carriage 14 and the recording head 30 are moved from the wiping position WP to the standby position 18. In the subsequent step ST7, the motor 149 is rotated at the number of steps X2, so that the second wiper 152 moves in the movement direction D without wiping the second wiping area WA2.

Next, in step ST9, it is determined that the wiping by the third blade 163 is required. Thus, in step ST10, the carriage 14 and the recording head 30 are moved from the standby position 18 to the wiping position WP. In the subsequent step ST11, the motor 149 is rotated at the number of steps X3, so that the third wiper 153 moves in the movement direction D while wiping the third wiping area WA3.

Subsequently, in step ST13, it is determined that the wiping by the fourth blade 164 is not required. Thus, in step ST16, the carriage 14 and the recording head 30 are moved from the wiping position WP to the standby position 18. In the subsequent step ST15, the motor 149 is rotated at the number of steps X4, so that the fourth wiper 154 moves in the movement direction D without wiping the fourth wiping area WA4.

In contrast, if the second and fourth wiping areas WA2, WA4 are to be wiped but not the first and third wiping areas WA1, WA3, the carriage 14 and the recording head 30 are moved to the standby position 18 in steps ST4 and ST12. Further, in steps ST6 and ST14, the carriage 14 and the recording head 30 are moved to the wiping position WP.

In the embodiment of FIG. 24, while a preceding one of the blades is wiping the nozzle plate surface 61, the succeeding blade may start wiping the nozzle plate surface 61. Even though at least two blades wipes the nozzle plate surface 61 at the same time, the load acting on the mechanism for moving the blades can be reduced, as compared to the case in which a single blade having a relatively large width wipes the nozzle plate surface 61 as a whole.

The illustrated embodiments may be modified as follows.

In each of the illustrated embodiments, each of the wipers 151 to 154 is engaged with the first threaded portions of the lead screws 181, 182, when the associated blade 161 to 164 starts contacting the nozzle plate surface 61 or when the blade 161 to 164 starts separating from the nozzle plate surface 61. However, each wiper 151 to 154 may be engaged with the second threaded portions of the lead screws 181, 182, when the associated blade 161 to 164 starts contacting the nozzle plate surface 61 or when the blade 161 to 164 starts separating from the nozzle plate surface 61.

The shape of each blade 161 to 164 is not restricted to the illustration but may be modified in different suitable manners, when necessary.

In the illustrated embodiments, the blades 161 to 164 wipe the nozzle plate surface 61 while moving in the movement direction D. However, the blades 161 to 164 may wipe the nozzle plate surface 61 while moving in an opposite direction of the direction D.

A cleaner member for cleaning the blades 161 to 164 may be provided in the carriage 14. In this case, with each of the blades 161 to 164 stopped at a predetermined position in the movement direction D, for example, the carriage 14 is moved in the main scanning direction T with respect to the blades 161 to 164. The cleaner member thus cleans the blades 161 to 164.

The serrated belt 141 of the driver 140 of FIG. 7 may be replaced by a line of gears. Further, as long as the wipers 151 to 154 are allowed to move smoothly without being dragged, one of the lead screws 181, 182 may be changed to, for example, a rod-like guide member. In this case, the wipers 151 to 154 are moved by the single lead screw.

In the illustrated embodiments, the four ink cartridges 2 to 5 carried by the carriage 14 respectively retain color inks of, for example, black, cyan, magenta, and yellow. However, the inkjet printer 10 may include only the ink cartridge retaining the black ink. Alternatively, the inkjet printer 10 may include two, three, or five or more ink cartridges. That is, for example, the inkjet printer 10 may include three ink cartridges for retaining three color inks, other than the black ink.

The number of the wipers is not restricted to four but may be changed as far as the number is not less than two. If the inkjet printer 10 has four ink cartridges respectively retaining black ink, cyan ink, magenta ink, and yellow ink but two wipers, the partitions 81 of the cap body 80 shown in FIGS. 3 and 4 may be omitted except for the intermediate one. In this case, the first and second nozzle opening lines 54A, 54B are subjected to the ink suction at one time. The first and the second nozzle opening lines 54A, 54B are then wiped at one time by a corresponding one of the wipers. Subsequently, the third and fourth nozzle opening lines 54C, 54D are subjected to the ink suction at one time. Then, the third and fourth nozzle opening lines 54C, 54D are wiped at one time by the other one of the wipers.

Alternatively, the nozzle opening lines wiped by one side of each blade may be different from the nozzle opening lines wiped by an opposing side of the blade. This structure reduces the quantity of the wipers with respect to the quantity of the ink cartridges.

The present invention is not restricted to application to the inkjet type recording apparatus but may be applied to various types of liquid ejection apparatuses. For example, the present invention may be applied to liquid ejection apparatuses ejecting liquid such as color material used for fabrication of color filters including liquid crystal displays, electrode material used for fabrication of electrodes of organic EL displays or surface emitting displays (FEDs), and bioorganic matter used for fabrication of biochips. The present invention is also applicable to sample ejection apparatuses as precision pipettes.

The illustrated movement device 138 is provided for moving the multiple wipers. Further, a device configured identical with the movement device 138 may be provided for moving different movable components other than the wipers of the liquid ejection apparatus. More specifically, other than the movement device 138 for moving the wipers, the liquid ejection apparatus may have a different movement device including at least one lead screw, which is engaged with a plurality of movable components and thus moves the components independently from one another.

The present examples and embodiments are to be considered as illustrative and not restrictive and the invention is not to be limited to the details given herein, but may be modified within the scope and equivalence of the appended claims.

The invention claimed is:

1. A liquid ejection apparatus ejecting a liquid from a nozzle opening surface of a liquid ejection head, the apparatus comprising:

a plurality of wipers moving in a predetermined movement direction with respect to the liquid ejection head for wiping the liquid from the nozzle opening surface, wherein each of the wipers includes a blade for wiping the nozzle opening surface and a holder member for holding the blade, each of the wipers being movable in the movement direction in an operational area for wiping the nozzle opening surface, a first non-operational area that precedes the operational area, and a second non-operational area that follows the operational area; and a movement device having a single driver, for moving the wipers in the movement direction in such a manner that, under the condition that the driver is being operated at a constant driving speed, the moving speed of only one of each adjacent pair of the wipers is changed when the one of the adjacent wipers is passed from the first non-operational area to the operational area or from the operational area to the second non-operational area while the other one of the adjacent wipers is moving in the first or second non-operational area, wherein the movement device includes a lead screw rotated by the driver for moving the wipers in the movement direction, wherein the lead screw has a first threaded portion and a second threaded portion, the first threaded portion having a feed pitch smaller than the feed pitch of the second threaded portion, and wherein each of the wipers is located in the first or second non-operational area when engaged with the first threaded portion but in the operational area when engaged with the second threaded portion.

2. The apparatus according to claim 1, wherein the movement device moves the wipers in such a manner that the moving speed of only one of the adjacent wipers is increased when the one of the adjacent wipers is passed from the first non-operational area to the operational area while the other one of the adjacent wipers is moving in the first or second non-operational area.

3. The apparatus according to claim 1, wherein the movement device moves each of the wipers at a relatively high speed when the wiper is moving in the operational area and at a relatively low speed when the wiper is moving in the first or second non-operational area.

4. The apparatus according to claim 1, wherein the movement device moves the wipers in such a manner that, after one of the wipers has moved out of the operational area, the following one of the wipers enters the operational area.

5. The apparatus according to claim 4, wherein the liquid ejection head is movable selectively to a predetermined wiping position and a standby position retreated from the wiping position, and wherein, while moving in the operational area, each of the wipers wipes the nozzle opening surface when the liquid ejection head is held at the wiping position, but does not wipe the nozzle opening surface when the liquid ejection head is held at the standby position.

6. The apparatus according to claim 1, wherein the wipers are arranged in the movement direction.

7. The apparatus according to claim 1, wherein the number of the pitches of the lead screw between the adjacent wipers is equal to or greater than the number of the pitches of the second threaded portion.

8. The apparatus according to claim 1, wherein the number of the pitches of the lead screw between the adjacent wipers is equal to or greater than the number of the pitches between the point of the lead screw at which each of the wipers is engaged with the lead screw when starting to contact the nozzle opening surface and the point of the lead screw at which each of the wipers is engaged with the lead screw when starting to separate from the nozzle opening surface.

9. The apparatus according to claim 1, wherein a plurality of nozzle opening lines are defined in the nozzle opening surface, and wherein each of the wipers corresponds to one of the nozzle opening lines.

10. The apparatus according to claim 1, wherein the wipers include different types of wipers.

11. The apparatus according to claim 1, wherein the adjacent wipers move at the same speed as each other when the adjacent wipers are in the first or second non-operational area, but move at different speeds from each other when one of the adjacent wipers is in the operational area.

12. A liquid ejection apparatus ejecting liquid from a nozzle opening surface of a liquid ejection head, the apparatus comprising:

a plurality of wipers moving in a linear movement direction with respect to the liquid ejection head for wiping the liquid from the nozzle opening surface in the movement direction, the movement direction being parallel to the nozzle opening surface, each of the wipers including a blade for wiping the nozzle opening surface and a holder member for holding the blade, and the holder members being separately arranged in the movement direction; and a movement device for moving the wipers in the movement direction for allowing the wipers to wipe the nozzle opening surface independently from one another so that when one of the wipers is wiping the nozzle opening surface, the remaining wipers are not wiping the nozzle opening surface, wherein the movement device includes a lead screw rotated for moving the wipers in the movement direction and a driver for rotating the lead screw, wherein the lead screw has a first threaded portion and a second threaded portion, the first threaded portion having a feed pitch smaller than the feed pitch of the second threaded portion, and wherein each of the wipers does not wipe the nozzle opening surface when engaged with the first threaded portion but wipes the nozzle opening surface when engaged with the second threaded portion.

13. The apparatus according to claim 12, wherein the movement device moves the wipers in such a manner that an interval between the holder members of each adjacent pair of the wipers in the movement direction when at least one of the adjacent wipers is wiping the nozzle opening surface is different from the interval when the adjacent wipers are not wiping the nozzle opening surface.

14. The apparatus according to claim 12, wherein the movement device moves the wipers in such a manner that the interval between the holder members of the adjacent wipers when at least one of the adjacent wipers is wiping the nozzle opening surface is larger than the interval between the holder members of the adjacent wipers when the adjacent wipers are not wiping the nozzle opening surface.

15. The apparatus according to claim 12, wherein the movement device moves each of the wipers at a relatively high speed when the wiper is wiping the nozzle opening surface and at a relatively low speed when the wiper is not wiping the nozzle opening surface.

16. A liquid ejection apparatus ejecting liquid from a nozzle opening surface of a liquid ejection head, the apparatus comprising:

different types of wipers moving in a predetermined movement direction with respect to the liquid ejection head for wiping the liquid from the nozzle opening surface, wherein each of the wipers is movable in the movement direction in an operational area for wiping the nozzle opening surface, a first non-operational area that precedes the operational area, and a second non-operational area that follows the operational area; and a movement device for moving the wipers in the movement direction independently from one another in such a manner that the different types of wipers wipe the same area of the nozzle opening surface, wherein the movement device includes a lead screw rotated for moving the wipers in the movement direction and a driver for rotating the lead screw, wherein the lead screw has a first threaded portion and a second threaded portion, the first threaded portion having a feed pitch smaller than the feed pitch of the second threaded portion, and wherein each of the wipers is located in the first or second non-operational area when engaged with the first threaded portion but in the operational area when engaged with the second threaded portion.

17. The apparatus according to claim 16, wherein the wipers are arranged in the movement direction.

18. The apparatus according to claim 17, wherein each of the wipers includes a blade for wiping the nozzle opening surface and a holder member for holding the blade, the blades of the wipers being different types of blades.

19. The apparatus according to claim 18, wherein the blades are different from one another in at least one of a dimension perpendicular to the nozzle opening surface, hardness, thickness, material, and shape.

20. The apparatus according to claim 18, wherein the blades are different from one another in a width of a wiping portion for wiping the nozzle opening surface.

21. The apparatus according to claim 18, wherein the blades include a blade having a side wiping portion for wiping a side surface of the liquid ejection head.

22. A liquid ejection apparatus ejecting a liquid from a nozzle opening surface of a liquid ejection head, the apparatus comprising:

a plurality of wipers moving in a predetermined movement direction with respect to the liquid ejection head for wiping the liquid from the nozzle opening surface, each of the wipers being movable in the movement direction in an operational area for wiping the nozzle opening surface, a first non-operational area that precedes the operational area, a second non-operational area that follows the operational area; and a movement device for moving the wipers in the movement direction in such a manner that an interval between each adjacent pair of the wipers in the movement direction when at least one of the wipers is moving in the operational is different from the interval when both wipers are moving in the first or second non-operational area, wherein the movement device includes a lead screw rotated for moving the wipers in the movement direction and a driver for rotating the lead screw, wherein the lead screw has a first threaded portion and a second threaded portion, the first threaded portion having a feed pitch smaller than the feed pitch of the second threaded portion, and wherein each of the wipers is located in the first or second non-operational area when engaged with the first threaded portion but in the operational area when engaged with the second threaded portion.

* * * * *